United States Patent [19]

Panopoulos

[11] Patent Number: 5,067,837

[45] Date of Patent: Nov. 26, 1991

[54] VARIABLE POINT WRITING INSTRUMENT

[76] Inventor: Peter J. Panopoulos, 9220 S. 87th Ct., Hickory Hills, Ill. 60457

[21] Appl. No.: 440,318

[22] Filed: Nov. 22, 1989

Related U.S. Application Data

[63] Continuation-in-part of Ser. No. 759,297, Jul. 26, 1985, abandoned.

[51] Int. Cl.[5] ..... B43K 8/02; B43K 9/00

[52] U.S. Cl. ..... 401/107; 401/108; 401/198; 401/202; 401/205

[58] Field of Search ..... 401/199, 202, 205, 107, 401/108, 258, 260, 196, 198

[56] References Cited

U.S. PATENT DOCUMENTS

| | | | |
|---|---|---|---|
| 938,846 | 11/1909 | Gunn | 401/205 X |
| 1,576,533 | 3/1926 | Mikeleitis | 401/205 X |
| 1,718,709 | 6/1929 | Savio | 401/107 |
| 2,629,123 | 2/1953 | Mahruki | 401/202 X |
| 3,336,909 | 8/1967 | Diamond | 401/260 |
| 3,463,597 | 8/1969 | Wakai | 401/202 X |
| 3,493,308 | 2/1970 | Sperry | 401/107 X |
| 3,684,389 | 8/1972 | Eron et al. | 401/202 X |
| 4,269,527 | 5/1981 | Lipfert et al. | 401/202 X |

FOREIGN PATENT DOCUMENTS

| | | | |
|---|---|---|---|
| 3105614 | 8/1982 | Fed. Rep. of Germany | 401/199 |
| 752980 | 7/1956 | United Kingdom | 401/258 |
| 1121393 | 7/1968 | United Kingdom | 401/260 |

*Primary Examiner*—Steven A. Bratlie

*Attorney, Agent, or Firm*—Basil E. Demeur; Robert E. Knechtel; Alan B. Samlan

[57] ABSTRACT

There is disclosed a variable tip writing instrument for imprinting characters, lines or segments of lines of variable diametric dimensions, to be used manually or incorporated into the designs of computer related printers, plotters, or typewriter devices with computerized controls, the writing instrument being of the type having a storage end and a writing end opposed from the storage end, and a barrel adapted to contain a supply of ink which is in communication with the writing tip, formed by a writing tip positioned at the writing end of the instrument, the writing tip having an expandable diameter thereby to vary between the smallest diametric dimension and the largest diametric dimension thereof, and control means associated with the writing tip having a control end in operative relationship with the writing tip and an opposed manipulative end positioned along the length of the instrument and adapted to permit the manipulative control of the writing tip to control the diametric dimension of the writing tip to any desired dimension between the smallest and largest diametric dimensions thereof.

3 Claims, 12 Drawing Sheets

205
207
212
206
211
209
208
210

215
223
217
218
222
216
221
219
220

231
225
230
226
228
227
232
229

241
240
242
237
238
236
239
235

253
252
252
251
249
246
248
245
247
250

259
258
256
255
256
257

261
260
264
265
262
263

268
270
269
274
272
272
273

277a
278
275
275a
279
276
284
277

VARIABLE POINT WRITING INSTRUMENT

CROSS-REFERENCE TO A RELATED APPLICATION

This application is a continuation-in-part application of co-pending application Ser. No. 759,297, filed July 26, 1985, and entitled VARIABLE POINT WRITING INSTRUMENT, filed in the name of Peter J. Panopoulos now abandoned.

BACKGROUND OF THE INVENTION

The art field with respect to writing instrument developed to the point where various writing instruments are available depending upon the particular job function which the instrument is intended to accomplish. Hence, it is well known that ballpoint pens have been developed which are either intended as permanent instruments, or throw away items which have a limited supply of ink, and when totally expended, are intended for throw away. In addition, ballpoint pens of the type having a number of different writing tips contained within a single barrel are known, and in the usual configuration, each of the separate barrels contains a different color ink, and each of the barrels being designed to be manipulated by control means of one form or another, such that a segregated colored ink cartridge may be manipulated into the writing position at the discretion of the user.

Other forms of writing instruments consist of felt tip pens having writing tips of various diametric dimensions which are intended for specific uses. For example, felt tip pens intended as high-lighters have been developed, usually employing a yellow ink supply and having a writing tip of a fairly substantial diametric dimension such that the user thereof may highlight various portions of a printed page for emphasis purposes. At the other end of the extreme, other forms of felt tip pens have been developed having very fine points, which are intended as writing instruments for printing characters on a page. It is well known, however, that in each and every instrument, the user must select a pen having the writing tip intended to satisfy a given function, since each of the writing instruments has a distinct tip intended for a particular purpose.

It is also well known that drafting instruments have been developed which again have variable tips contained within the same writing instrument however, in each instance, each of the different tips has a distinct diameter, and each is controlled by means of certain segregated control means to extend and retract each of the segregated writing tips. Hence, the ability to vary the diametric dimension of a drafting line is a function of extending into the writing position a particular tip having a distinct diametric dimension.

Heretofore, however, no writing instrument has been developed which has a single writing tip capable of being varied between a small and a large diametric dimension by means of appropriate control means associated therewith. It will be appreciated that there are various job functions wherein it is not only appropriate, but important to be able to vary the thickness or diameter of various line dimensions incident to the creation of that particular job function. Heretofore, no writing instrument has been developed wherein the writing tip may be varied without changing the tip. As indicated previously, while writing instruments exist which have a plurality of tips each of which may be separately controlled in order to vary the thickness of the printed or written characters, a writing instrument having a single writing tip but which is variable in diametric dimensions does not exist. It has therefore been deemed important to develop a writing instrument wherein a single tip may be employed, but which tip may be alternately varied between a small and large dimension by means of a single control means incorporated within the design and construction of the instrument.

OBJECTS AND ADVANTAGES

It is therefore the principal object of the present invention to provide a variable tip writing instrument for printing, drawing or plotting, whether manually or mechanically, of the type having a storage end and a writing end opposed from the storage end, and a supply of ink in the storage end which is in communication with the writing tip, formed by a writing tip positioned at the writing end of the instrument, the writing tip having an expandable diameter thereby to vary between the smallest diametric dimension and the largest diametric dimension thereof, and control means having a control end in operative relation with the writing tip and an opposed manipulative end positioned along the length of the instrument and adapted to permit the manipulative control of the writing tip in order to control the diametric dimension of the writing tip to any desired dimension between the smallest and largest diametric dimensions thereof.

In conjunction with the foregoing object, it is a further object of the present invention to provide a variable tip writing instrument of the type described, wherein the writing tip comprises a continuous flexible filament, which may be elastic, mechanical, or membranous, porous or non-porous having one end fixedly secured to the barrel or other portion of the instrument and an opposed end fixedly secured to the control means whereby the manipulative movement of the control means relative to the barrel varies the diametric dimension of the writing tip in order to present a writing tip of variable and adjustable diametric dimension thereby to effect the variation of the thickness of the written characters.

In accordance with the foregoing object, it is a further object of the present invention to provide a variable tip writing instrument of the type described wherein the writing tip comprises a continuous concentrically arranged flexible filament having an outer end fixedly secured to the barrel of the instrument and an opposed end fixedly secured to the control means, the control means formed by a control rod reciprocably carried within the barrel of the instrument and being sequentially reciprocable between a fully retracted position and a fully extended position such that upon full retraction of the control rod, the maximum concentric diameter of the filament as a writing tip is exposed, whereas the progressive extension of the control rod exposes the minimum concentric diameter of the filament as a writing tip thereby to vary the diameter of the writing tip between the maximum and the minimum diametric dimension thereof.

In accordance with the foregoing objects, it is a further object of the present invention to provide a variable tip writing instrument of the type described wherein the writing tip may be formed by a concentrically arranged track fixedly secured to the barrel and disposed at the writing end thereof and the flexible filament is formed by an elastic cord carried in the control means and adapted to be progressively fed into and out of the track by the control means such that the continuous feeding of the filament into the track varies the diametric dimension of the writing tip between the smallest dimension thereof to the largest dimension thereof.

Still a further object of the present invention, in accordance with the prior object and advantages, is to provide a variable tip writing instrument of the type described wherein the writing tip may be formed by a U-shaped flexible filament positioned within the barrel of the writing end of the instrument, the filament having a U-shaped portion positioned within the upper confines of the barrel and a pair of opposed legs positioned at the lower end of the writing tip end, and the control means being fixedly secured to the U-shaped portion such that the reciprocating movement of the control means in a direction away from the barrel exposes greater lengths of the opposed legs of the U-shaped filament in order to increase the diametric dimension of the filament, while the reciprocating movement of the control means into the barrel exposes the smallest lengths of the opposed legs of the U-shaped filament thereby exposing the smaller diametric dimension of the filament as a writing tip.

In conjunction with the foregoing object, it is a further object to provide a variable writing tip instrument of the type described wherein the U-shaped filament is provided with a leaf spring core which normally biases the opposed ends of the U-shaped filament in spread apart orientation such that upon the reciprocating movement of the control means downwardly and away from the barrel, the opposed legs of the U-shaped filament will be biasingly urged in a spread apart relationship.

In conjunction with all of the foregoing objects, it is a further object of the present invention to provide a variable tip writing instrument of the type described wherein the writing tip may comprise a plurality of concentrically oriented tubules positioned in telescoping relationship with respect to one another and being telescopically movable with respect to each other, each of the tubules provided with separate tube extender means for moving each of said tubules into and out of a writing tip position, whereby the writing tip may be varied in diametric dimension by extending each of the telescopically oriented tubules into and out of writing tip orientation.

It is still a further object of the present invention as to provide a variable writing tip instrument of the type described, as a further alternative embodiment, wherein the writing tip comprises a coiled filament having an outer end secured to the barrel of the instrument and inner end secured to the control means, whereby the manipulative movement of the control means causes a concomitant movement of the inner end of the coiled filament relative to the outer end thereof such that the diametric dimension of the coiled filament presenting the writing tip may be varied between the maximum and the minimum diametric dimension thereof and thereby vary the thickness of the writing tip.

As a further object of the present invention, there is provided a variable writing tip instrument of the type described above, and as a further embodiment thereof, wherein the coiled filament comprises a rolled coil and the control means comprises a control rod mounted to the inner end of the rolled coil and adapted for rotary movement, such that the rotary movement of the control rod in one direction results in the rolled coil being manipulated into a small coil thereby to present a small diametric dimension, while the reverse rotary movement results in the rolled coil being manipulated into the largest coil in order to present the largest writing tip possible.

As a further embodiment in conjunction with the foregoing object, it is yet another object of the invention to provide a variable tip writing instrument of the type described wherein the writing tip is formed by a coiled filament formed into a rolled coil and the control means is formed by a control rod which is mounted to the inner end of the rolled coil and is mounted for vertically reciprocating movement within the confines of the barrel, whereby the vertical reciprocating movement of the control rod causes a concomitant vertical movement of the inner end of the coiled filament relative to the outer end thereof in order to vary the diametric dimension of the writing tip between the smallest coil tip and the largest coil tip thereby varying the thickness of the writing tip end.

As a further embodiment of the present invention, and in conjunction with the foregoing objects, a further object of the invention is to provide a variable writing tip instrument of the type described wherein the writing tip is formed by a flexible filament which includes an extension portion extending outwardly from the writing end of the barrel, the extension portion forming the writing tip, and being surrounded by a flexible arrest collar, the arrest collar including an upper relatively stationary portion and a lower flex portion, and flexing means associated with the lower flex portion whereby the flexing means is adapted to effect a constricting flex movement of the lower flex portion thereby to constrict the flexible filament into the smallest diametric dimension, while the reverse flex movement of the arrest collar will produce an unflexing movement of the lower flex portion thereby to permit enlargement of the flexible filament into the largest diametric dimension thereof such that the writing tip may be varied between the smallest and largest diametric dimensions.

Still another object of the present invention is to provide an additional alternative embodiment of a variable writing tip instrument of the type described, wherein the writing tip is formed by a plurality of filament segments, each segment being arranged in a circular configuration and disposed in sequential overlapping relation, and the control means is formed by a control rod adapted for vertical reciprocating movement and having a segmented lower end formed with the same number of segments as the number of filament segments, each of the filament segments being fixedly secured to a corresponding control rod segment, the control rod segment being flexible and normally biased into spread apart position, and the barrel of the instrument presenting a restricted circular opening whereby the control rod segments are biasingly urged together when the control rod is moved vertically into the barrel of the instrument thereby to present the smallest diametric dimension of the writing tip end, while the reverse movement of the control rod permits the control rod segments to biasingly spread to their fullest extant thereby to present the largest diametric dimension of the writing tip when the control rod is fully extended away from the barrel.

Yet another object of the present invention is to provide a further alternative embodiment of a variable tip writing instrument of the type generally described above, wherein the writing tip is formed by a plurality of writing tubules, the tubules being arranged in concentrically oriented ringlet bundles and having a single tubule forming the center of the concentric bundle, the center tubule being disposed in its fully vertically extant position in normal disposition with each successive ringlet bundle being in a slightly raised position relative to the next successive ringlet bundle in normal disposition, each of the ringlet bundles having a latch catch associated therewith, and a control means formed by a latch carried on the barrel and adapted to engage a corresponding latch catch on each successive ringlet bundle as the same travel upwardly into latch receiving position with respect to the latch, whereby the assertion of a force against the writing tip causes each successive ringlet bundle to travel upwardly until a corresponding latch catch engages the latch thereby varying the diametric dimension of the writing tip between the smallest diametric dimension and the largest diametric dimension thereof.

Still another object of the present invention is to provide a variable writing tip instrument of the type described wherein the writing tip comprises a vertically positioned mask band, the mask band being formed as a continuous band and extending over vertically spaced rollers mounted within the barrel of the instrument, including an upper roller containing a control knob for controlling the rotary movement of the roller and a pair of horizontally spaced apart lower rollers, the mask band including a plurality of variously sized writing apertures formed therein and adapted for operative positioning at the writing end of the instrument, whereby the rotary movement of the control knob causes a concomitant movement of the mask band thereby to position one of the variously sized writing apertures at the writing end of the instrument in order to vary the diametric dimensions of the writing tip between the smallest and largest diametric dimensions thereof.

Further features of the invention pertain to the particular arrangement of the parts and elements whereby the above-outlined objects and advantages and additional operating features thereof are attained.

The invention, as to its method of operation, in arrangement of the parts and elements will be better understood by reference to the accompanying drawings, and the following specification.

BRIEF DESCRIPTION OF DRAWINGS

FIG. 10a is a side elevational view, in partial cross section, showing an alternate form of a writing tip instrument wherein the writing tip is formed by a rolled coil and the control rod is connected to the center of the rolled coil and showing the rolled coil in its fully extended position displaying the smallest diametric dimension thereof;

FIG. 12a' is a bottom view of the writing tip instrument as shown in FIG. 12a, illustrating the smallest diametric dimension of the writing tip end;

FIG. 12b' is a bottom view showing the writing tip instrument of FIG. 12b, with the writing tip end in its maximum diametric dimension;

FIG. 55*a* is a bottom view, partly in phantom, showing the pivotal movement of the writing fingers of the embodiment as shown in FIG. 55 above;

SUMMARY OF THE INVENTION

Figure 1A:
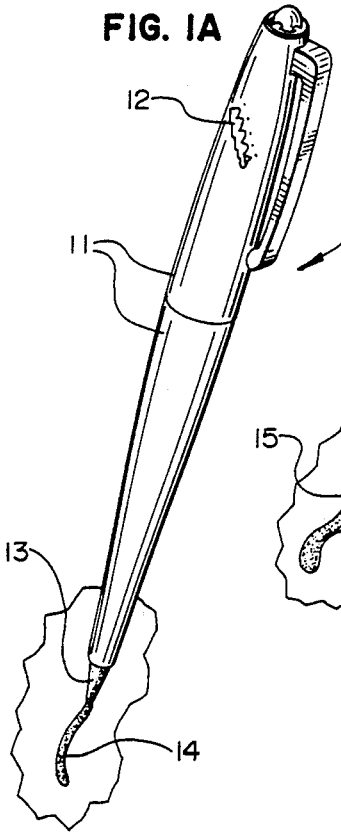
FIG. 1*a* is a plan view of a variable writing tip instrument of the present invention illustrating schematically the smallest diametric dimension of the writing tip end thereof.

In summary, the present invention is intended to provide a variable tip writing instrument shown in a variety of embodiments, all of which are intended to provide a writing instrument having a writing tip end which may be varied between a maximum and a minimum diametric dimension in order to vary the thickness of a character being imprinted thereby. In each embodiment of the invention, the writing instrument of the present invention is intended to include control means which is in operative relationship with respect to the writing tip end, in order to permit the variation of the writing tip between maximum and minimum diametric dimension, a writing tip which is sufficiently flexible in order to be flexed and unflexed between the maximum and the minimum diametric dimensions, or in the alternative, may be segmented in order to produce a writing tip which may be expanded and retracted between the maximum and the minimum diametric dimensions thereof. As has been depicted in the drawings and briefly described, each embodiment of the invention permits the user thereof to quickly and efficiently manipulate the control means in order to cause a concomitant movement in the writing tip such that the same writing tip may be adjusted in terms of the diametric dimension thereof thereby to vary the thickness of the character imprinted.

DETAILED DESCRIPTION OF DRAWINGS

As indicated previously, the present invention is intended to present a variable tip writing instrument pursuant to which the writing tip of the instrument may be varied between a maximum and a minimum diametric dimension, without at the same time requiring or necessitating that the writing tip be individually changed to an alternate writing tip in order to effect a change in the thickness of the printed character. As such, it has been determined that the variable tip writing instrument of the present invention may be presented in various alternative embodiments, but nevertheless, resulting in the same effect. Following below is a detailed description of the drawings pursuant to which the various embodiments and the manner in which each operates is delineated.

With reference to FIG. 1*a* of the drawings, there is shown a writing instrument 10 in accordance with the present invention in the form of a pen formed by a barrel portion 11, having control means 12 located adjacent to the top portion thereof, and fine writing tip 13 located at the opposed end thereof. It will be observed that the fine writing tip 13 produces a written character consisting of a relatively fine line, represented by the numeral 14.

Figure 1B:
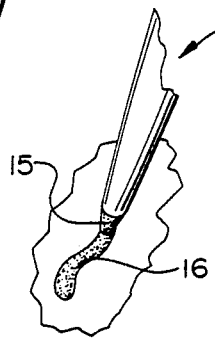
FIG. 1*b* illustrates the same writing instrument as depicted in FIG. 1*a*, illustrating an enlarged diametric dimension of the writing tip end thereof.

FIG. 1*b* represents the identical writing instrument 10 having had the control means 12 manipulated accordingly such that the writing tip has now been manipulated to a medium writing tip 15 producing a medium thickness line as generally represented by the numeral 16.

Figure 1C:
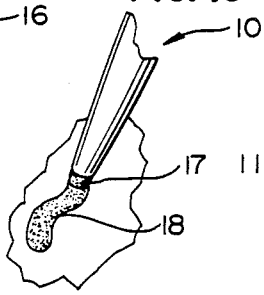
FIG. 1*c* shows the largest diametric dimension of the writing tip end of the instrument as depicted in FIG. 1*a;*

As shown in FIG. 1*c*, the writing instrument 10 is shown to have the writing tip 17 manipulated into the thick writing tip 17 which presents the maximum diametric dimension thereof, thereby to result in a thick line 18 being produced.

Figure 2A:
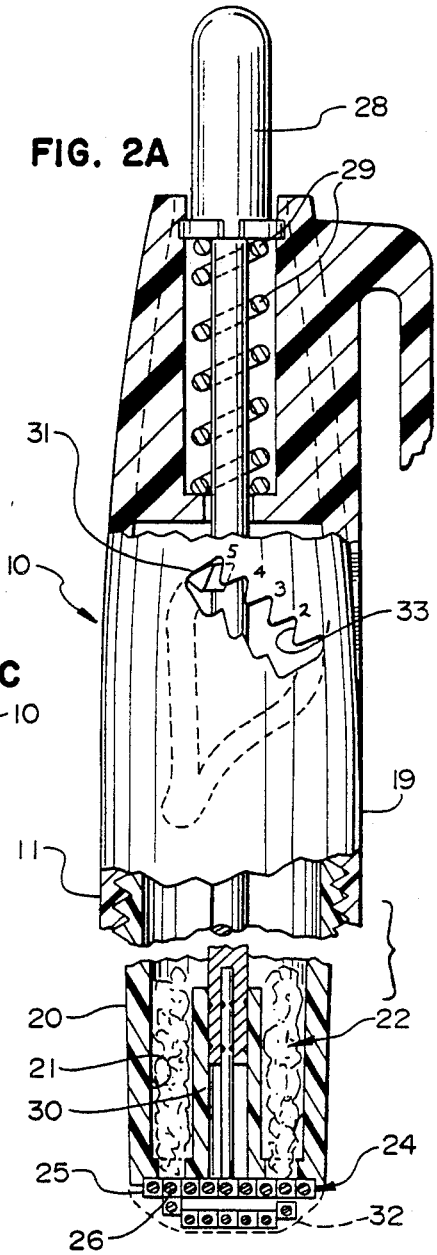
FIG. 2*a* is a side elevational view, in cross section, and partly broken away, showing one alternative embodiment of a variable writing tip instrument in accordance with the present invention wherein the writing tip end is positioned at its maximum diametric dimensions.
Figure 2B:
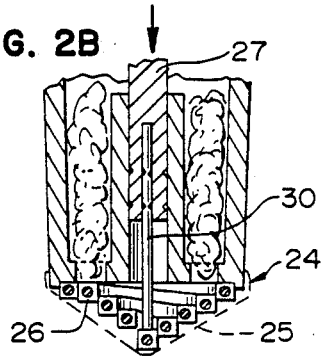
FIG. 2*b* is a side elevational view, in cross section, and broken away, showing the writing tip end of a writing tip instrument as depicted in FIG. 2*a*, wherein the writing tip end is fully extended presenting the smallest writing tip diametric dimension.

FIGS. 2*a* and 2*b* illustrate one of the preferred embodiments of the present invention, in illustrating greater detail the writing instrument 10 as depicted in FIG. 1*a*. It will be observed that the barrel portion 11 is shown to be actually formed by an upper barrel 19 and a lower barrel 20 which are screw threaded together in a manner commonly observed with respect to other writing instruments. The lower barrel 20 includes a chamber 21 which is packed with an ink storing material such as felt 22 which provides the supply of ink for the writing tip 24. In this embodiment, the writing tip 24 is shown to be formed by a continuous concentrically arranged flexible filament 25 having the outer concentric ring fixedly secured to the lower end of the barrel 20, and the inner end thereof secured to the control rod 27. The control rod 27 is shown to extend throughout the entire length of the writing instrument 10 and terminating in an upper thumb push extension 28 which is spring loaded by means of coil spring 29 in a manner typical in such writing instruments. Of course, the positioning of the spring 29 may be varied depending upon the manufacturing procedures utilized. The lower end of the control rod 27 is provided with a fine tip end 30 which is fixedly secured to the inner end of the concentric filament 25 in the manner shown in FIGS. *2a* and *2b*. Disposed intermediate the thumb push extension 28 and the fine tip end 30 is a stop boss 31 fixedly secured to the control rod 27. It will be observed that the upper barrel 19 is provided with a step slot 33 which accommodates the stop boss 31 therethrough. The control rod 27 is designed to rotate or move within the confines of the barrel 11 in order to permit the stop boss 31 to be arrested by any one of the steps forming the step slot 33 such that a variable portion of the fine tip end 30 may be pushed forward of the writing tip end 24.

As shown in FIG. *2b*, when the control rod 27 is extended to its further extant with the stop boss 31 in the lowest step of the step slot 33, the fine tip end 30 of the control rod 27 is pushed to its furthest extension from the writing tip end 24 of the instrument 10. From this position, the inner most end of the concentric filament 25 is exposed as the writing tip thereby producing the finest line which the writing instrument 10 is capable of producing. When the control rod 27 is retracted such that the stop boss 31 is located in the uppermost step of the step slot 33, as shown in FIG. *2a*, the concentric filament 25 is basically flush with respect to the writing tip end 24, and produces the maximum diametric dimension of the written line.

It will further be observed that to provide further stability for the concentric filament 25, the filament may contain a support core 26 which not only stabilizes the filament 25, but gives the filament 25 structural integrity. The support core 26 may be formed of any desirable material such as wire, plastic, rubber, metals, or other resins.

As a further possible feature, the writing tip end 24 may be enveloped by an elastic membrane 32 (shown in phantom) which is permeable or semi-permeable with respect to the ink. It is contemplated that the membrane 32 may provide a more uniform flow of ink during the writing process, although such a membrane is not essential.

Figure 3:
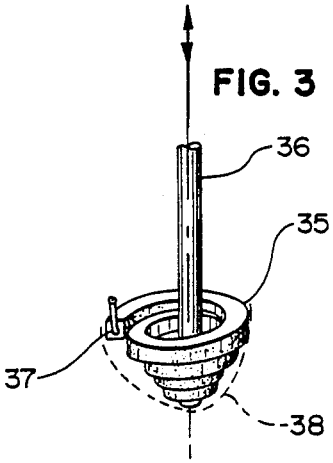
FIG. 3 is a front plan view of the writing tip end of the instrument as depicted in FIG. 2*a;*

FIG. 3 illustrates a writing tip end 35 which again is controlled by a control rod 36 which may be designed to reciprocate upwardly and downwardly in order to vary the diametric dimension of the writing tip 35 which is exposed for writing purposes. It will be observed that, once again, the writing tip 35 is in the form of a concentrically oriented filament having the outer end 37 fixed to the lower end of the barrel, and the inner end (not shown) fixed to the control rod 36. An elastic membrane 38 (in phantom) may similarly be provided enveloping the writing tip end 35 as discussed above.

With respect to FIGS. *4a* and *4b* of the drawings, still another alternate embodiment of a writing tip instrument of the present invention is illustrated. For sake of convenience with respect to all of the embodiments to be described hereinafter, similar reference numerals will be utilized with respect to the writing instrument 10, and the barrel portions 19 and 20 thereof.

As shown in FIG. *4a*, the lower barrel 20 is shown to contain a chamber 21 which contains a felt material 22 which functions as the ink reservoir as previously described. The lower end forms a writing tip end 24 which, in this embodiment, is shown to include a stationary concentric track 40 which is fixed to the writing tip end 24. The control rod 27 is shown to be stationary in this embodiment, and functions as an anchoring post for the corded filament 41. The terminal end 42 of the corded filament 41 is fixedly secured within the inner confines of the lower end of the control rod 27 and is in communication with the ink reservoir formed by the felt material 22.

Adjacent the writing tip end, the barrel is appropriately slotted as depicted at numeral 44, and is shown to be provided with a thumb wheel 45 having an elongated aperture 46 formed therethrough. It will be observed that the corded filament 41 is fed through the elongated aperture 46 and enters the concentric track 40 in the manner illustrated. It will be appeciated that as the thumb wheel 45 is rotated in a counterclockwise direction, the corded filament 41 is caused to be removed from the anchored control rod 27 and fed into the concentric track 40. It will be appreciated that as that action continues, a greater diametric dimension of the writing tip of the instrument 10 will be exposed for writing purposes, whereas the reverse rotational movement of the thumb wheel 45 in a clockwise direction will withdraw the corded filament 41 from the track 40 thereby exposing the minimum amount of material as a writing tip for the instrument.

Figure 4A:
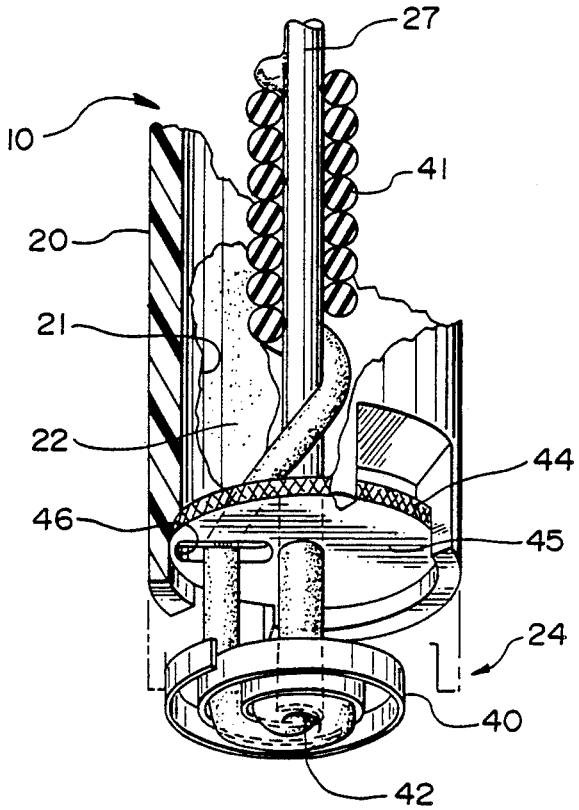
FIG. 4*a* is a side elevational view, in cross section, showing an alternative embodiment of a variable writing tip end which includes a spiral track and a flexible filament which may be fed into and retracted from the spiral track in varying degrees in order to vary the thickness of the written characters.
Figure 4B:
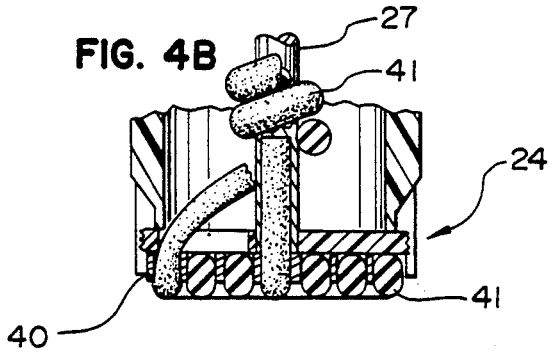
FIG. 4*b* is a side elevational view, broken away and in cross section, showing the writing tip end at its maximum diametric dimension.

As illustrated FIG. *4b*, it will observed that the writing tip has been rotated to its maximum counterclockwise position such that the corded filament 45 is positioned in each of the raceways forming the concentric track 40. This configuration would produce the maximum thickness of a printed character formed by the writing instrument 10 as described with respect to FIG. 4.

It is contemplated that the track 40 may be eliminated if the filament can be designed to wrap around itself, as an alternative embodiment. However, with respect to this embodiment, the track 40 appears to give structural integrity to the writing tip end and is preferred.

In FIGS. *5a* and *5b*, still another embodiment of a variable tip writing instrument is illustrated. In this instance, the lower barrel 20 is shown to be provided with a chamber 48, through which a control rod 49 extends throughout the entire length of the instrument. The writing tip end 50 is shown to be flared outwardly somewhat and accommodates a writing filament 51 extending outwardly therefrom, which may be in the forms of a U-shaped strand filament or a continuous conical filament which is U-shaped in cross-section. The writing filament 51 is shown to contain a leaf spring 52 forming the central core thereof, the leaf spring 52 being similarly U-shaped in configuration, and having opposed legs which are normally biased away from one another as generally shown in FIG. *5a*.

The control rod 49 is connected to the U-shaped portion 53 of the filament 51 and operates to extend the writing filament 51 downwardly whereby the opposed legs 54 and 55 are spread to their maximum extant, as shown in FIG. *5a* of the drawings, and present the maximum diametric dimension of the writing tip for the instrument 10. As shown in FIG. *5b*, the control rod 49 is reciprocated upwardly thereby to retract the U-shaped writing filament 51 within the confines of the chamber 48, which then retracts the opposed legs 54 and 55 into touching contact, thereby exposing the minimum diametric dimension of the writing tip for the instrument 10.

Figure 5A:
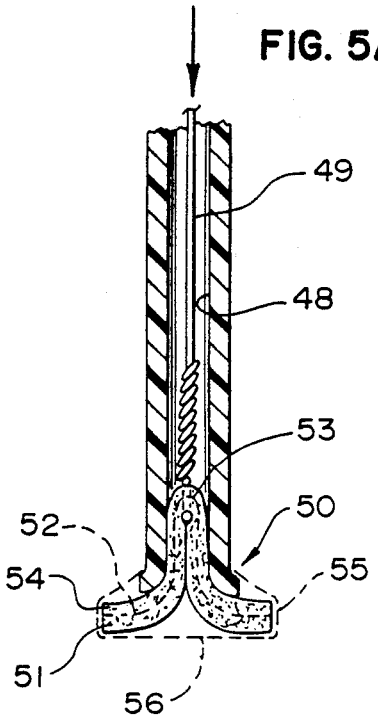
FIG. 5*a* is a side elevational view, in cross section, showing still another alternative embodiment of a variable writing tip wherein the writing tip is formed by a U-shaped flexible filament, wherein the opposed legs of the U-shaped filament are normally biasingly urged in a spread apart relationship by means of a leaf spring core.
Figure 5B:
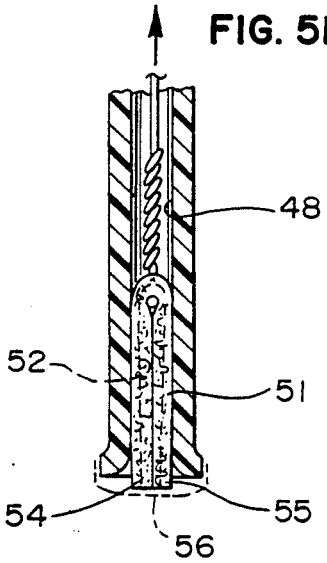
FIG. 5*b* is a side elevational view, in cross section and broken away, showing the writing tip as depicted in FIG. 5*a*, with the exception that the control means is fully retracted such that the opposed legs of the U-shaped filament are in their smallest diametric dimensions.

It is further contemplated that the U-shaped filament 51 may be conical in overall configuration but would operate functionally identical to what is shown in FIGS. 5*a* and 5*b*.

Again, an elastic membrane 56 (in phantom) may be provided in enveloping relation to the writing tip end 50 such that the legs 54 and 55 of the filament 51 may alternately spread and retract the membrane 56 as the same are reciprocated between the largest and smallest diametric dimensions of the writing tip end 50.

With respect to FIGS. 6*a* through 6*d*, and FIGS. 7 and 8, still another alternate embodiment of a variable tip writing instrument is disclosed. Once again, the writing instrument 10 is shown to be formed by a barrel portion 11 which is in turn composed of an upper barrel 19 and a lower barrel 20, the upper and lower barrels 19 and 20 respectively being screw threaded together as is customary with respect to such instruments. In this embodiment, the upper barrel 19 is shown to be provided with a chamber 57 which includes the ink supply reservoir 58. The lower barrel 20 is provided with a chamber 59 and accommodates a plurality of concentrically oriented writing tubules generally depicted by the numeral 60. In the embodiment as illustrated in FIG. 6*a* through 6*d*, there is shown a series of four concentrically oriented tubules 61, 62, 63 and 64 respectively which are adapted to be telescopically movable one with respect to the next. Each tubule is in the form of a hollow rod which extends throughout the entire length of the lower chamber 59. It will be noted that the center tubule 64 is in open communication with the ink reservoir 58, such that ink may travel down to the tip end of the center tubule 64. If desired, each of the other tubules 61, 62, and 63 may be provided with pores to permit ink to travel from the center tubule 64 to the other tubules 61, 62, and 63 respectively, or to be in open communication with the ink reservoir.

Figure 6A:
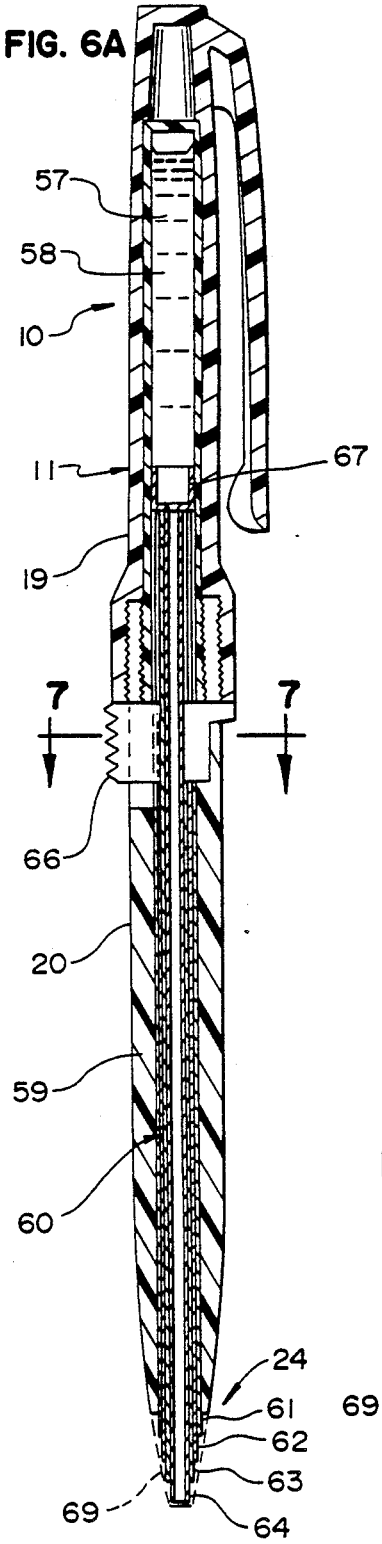
FIG. 6*a* is a side elevational view, in cross section, showing still another alternative embodiment of a variable writing tip instrument formed by a plurality of telescopically arranged tubules arranged for telescopic movement one with respect to the other, thereby to vary the writing tip end of the instrument.
Figure 7:
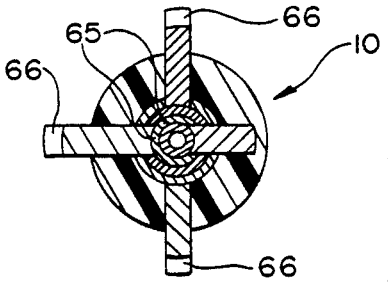
FIG. 7 is a top cross-sectional view, showing the individual control means for each of the telescopically oriented tubules in the manner in which the same operate one with respect to the other.
Figure 8:
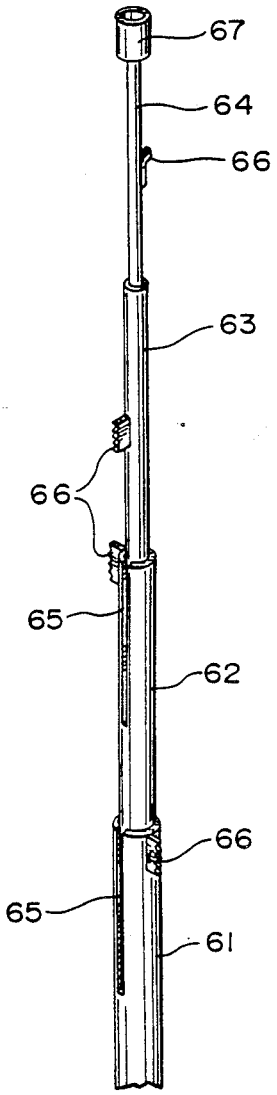
FIG. 8 is a side elevational view, in telescopically fully extended position, showing the manner in which each of the tubules is telescopically arranged with respect to the next adjacent tubule, and having the control means for each tubule fitted within appropriate slotted openings of each of the next adjacent tubules.
Figure 6B:
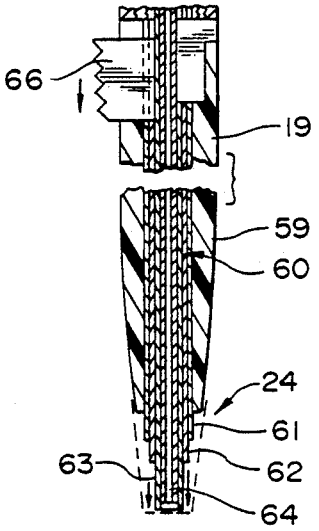
FIG. 6*b* is a side elevational view, in cross section, and broken away, showing the writing tip instrument as depicted in 6*a*, in a progressively larger diametric dimension.
Figure 6C:
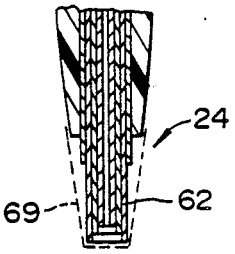
FIG. 6*c* is still another side elevational view, in cross section, and broken away, illustrating the writing tip end of the instrument depicted in 6*a*, showing still further a larger diametric sizing of the writing tip end caused by the progressive telescoping configuration of the writing tubules.
Figure 6D:
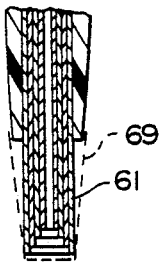
FIG. 6*d* is still another view of the writing instrument as depicted in 6*a*, in side elevational and cross-sectional view, illustrating the largest diametric dimension of the subject writing tip end thereof.

It will further be noted that each of the tubules 61, 62, 63 and 64 is appropriately slotted (see FIG. 8) and as represented by the numeral 65, with each tubule being provided with a thumb push 66 as illustrated. It will therefore be appreciated that each tubule may be separately manipulated into writing position by extending the thumb push 66, or any other appropriate mechanical control, until the tip end of the tubule is in touching and writing contact at the writing tip end 24 of the instrument. As depicted in FIGS. 6*a* through 6*d*, the sequential positioning of each of the tubules 61, 62, 63 and 64 into writing contact is illustrated. It will therefore be appreciated that when the center tubule 64 is the sole tubule in writing contact, the smallest diametric dimension of the variable writing tip instrument 10 is exposed. In FIG. 6*b*, the second telescopically writing tubule 63 has now been extended into writing contact, such that the diametric dimension of the writing tip is increased by the thickness thereof thereby to widen the printed character. In FIG. 6*c*, the third largest tubule 62 has been placed into writing contact thereby to again increase the diametric dimension of the printed character, while in FIG. 6*d*, the largest tubule 61 has been ejected into writing contact thereby to maximize the thickness of the printed character. In each instance, the ink supply is maintained via the center tubule 61, since the hollow core thereof is in open communication with the ink reservoir 58. As depicted in FIGS. 7 and 8, by having a slotted portion 65 associated with each tubule respectively, and a thumb push 66 associated with each concentrically arranged tubule, the thumb push 66 will be accommodated by the slot 65 in the next adjacent tubule so that each of the tubules may be separately manipulated into and out of writing position. As shown in FIGS. 6*a* and 8, the center tubule 64 is provided with an ink chamber 67 at the top end thereof which remains in open contact with the ink reservoir 58. It is further contemplated that the instrument 10 may be provided with appropriate stop locks such that each thumb push 66 may be locked into position once it has been fully extended along the length of the slotted portion 65 of the next adjacent tubule in a manner well known in the art. By providing appropriate stop and lock positions, each tubule 61–64 may be locked into writing position.

As with other embodiments previously depicted, the writing tubules may be enveloped by an elastic membrane 69 (in phantom) to provide a smoother flow of ink during the writing process.

Figure 9A:
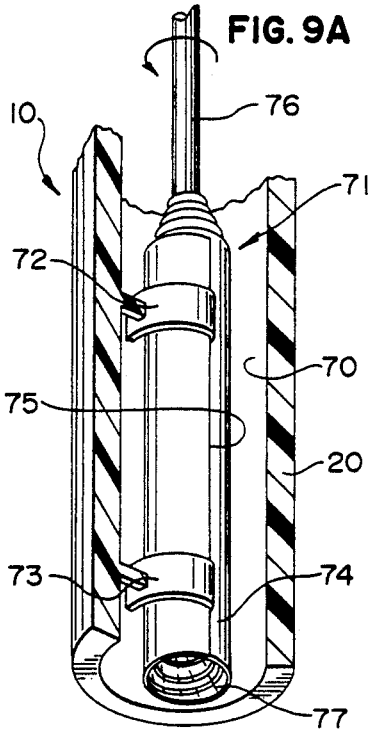
FIG. 9*a* is a side elevational view, in partial cross section, illustrating still another alternative embodiment of a variable writing tip instrument in accordance with the present invention, the writing tip being formed by a rolled coil and the control means formed by a control rod which is rotatably movable thereby to roll the coil into its smallest diametric dimensions.
Figure 9B:
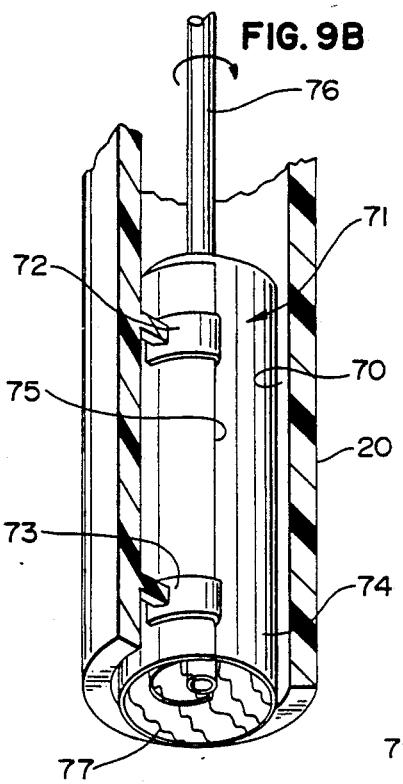
FIG. 9*b* is a side elevational view, in partial cross section, illustrating the writing tip end of the instrument as shown in FIG. 9*a*, with the rolled coil being manipulated into its largest diametric dimension thereof.

With respect to FIGS. 9*a* and 9*b* of the drawings, still another alternate embodiment of a variable tip writing instrument is illustrated. In this embodiment, the lower barrel 20 is provided with a chamber 70 which accommodates the writing tip 71 therein. It will be observed that the interior of the lower chamber 70 is provided with a pair of spaced apart grips 72 and 73 respectively, and that the writing tip 71 is in the form of a rolled coil filament 74. The outer end 75 of the rolled coil 74 is shown to be fixedly secured to the two grips 72 and 73, whereas the innermost end of the rolled coil (not shown) is fixedly secured to the control rod 76. The control rod 76 is adapted for rotary movement by means of an appropriate grip located at some portion of the upper barrel end of the instrument 10 (not shown) in a manner as illustrated previously, or as otherwise known in the art. It will also be observed that the interior portion of the control rod 76 is hollow, and is in open communication with the ink reservoir which again, is located upwardly from the writing tip end of the instrument 10.

As shown in FIG. 9*a* of the drawings, the rolled coil is illustrated to be in its tightly rolled configuration such that the tip end thereof which is presented for writing purposes is in its smallest diametric dimension. As shown in FIG. 9*b* of the drawings, when the control rod 76 is manipulated in the clockwise direction, the rolled coil 74 is essentially uncoiled such that the tip end of the rolled coil 74 is disposed in its maximum uncoiled configuration presenting the maximum diametric dimension thereof for writing purposes. Again, as a further alternative, an elastic membrane 77 (in phantom) may be secured to the rolled coil tip 74 which expands and retracts in response to the movement of the coil tip 74.

Figure 10A:
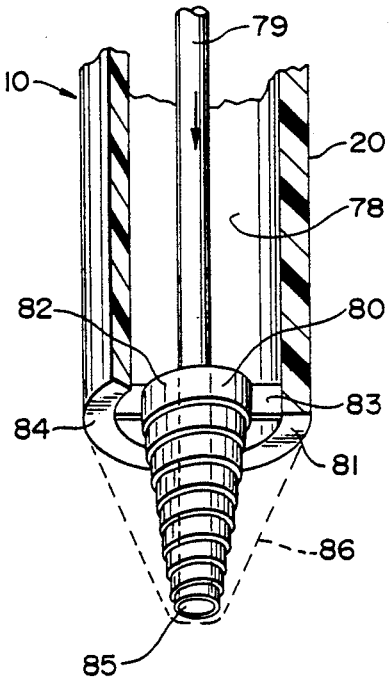
FIG. 10*a* is a side elevational view, in partial cross section, illustrating the writing tip end of the instrument as shown in FIG. 9a, with the rolled coil being manipulated into its largest diametric dimension thereof.
Figure 10B:
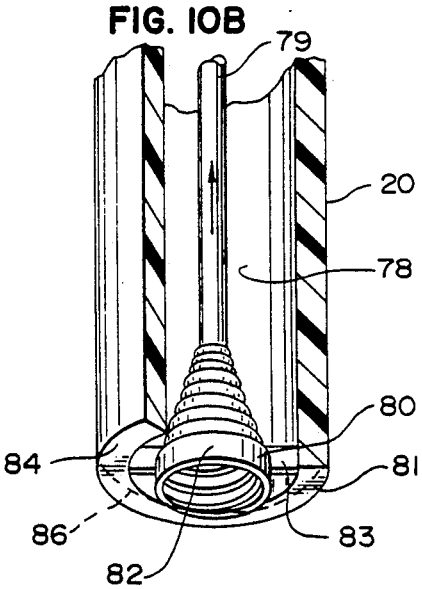
FIG. 10b is side elevational view in partial cross section, illustrating the writing tip as depicted in FIG. 10a, but with the control rod reciprocated upwardly such that the rolled coil presents the largest diametric dimension thereof.

With respect to FIGS. 10*a* and 10*b* of the drawings, still another alternate embodiment of the invention is illustrated. The embodiment as illustrated in FIGS. 10*a* and 10*b* of the drawings is somewhat similar to the embodiment as depicted in FIGS. 2*a* and 2*b* of the drawings, in terms of mode of operation. As depicted therein, once again, the writing instrument 10 includes a lower chamber 78 formed in the lower barrel portion 20 of the instrument 10. The control rod 79 is shown to be accommodated within the chamber 78, and terminates in the writing tip 80 which is secured at the tip end 81 of the instrument 10. The writing tip 80 is shown to be formed as a concentrically rolled coil wherein the outer concentric ring 82 thereof is securely fixed to the tip end 81 of the barrel by means of appropriate grips 83 and 84 respectively. The innermost concentric coil 85 is fixedly secured to the lower end of the control rod 79, and it will be observed that the control rod 79 is adapted for reciprocating movement in an upward and downward direction. Hence, where the user desires the minimum diametric dimension of the writing tip 80, the control 79 is manipulated downwardly such that the innermost concentric coil is presented for writing purposes. In the alternative, where the maximum diametric dimension of the writing tip is desired, the control rod 79 is moved upwardly, thereby presenting the fixed outermost coil 82 of the writing tip 80 in writing configuration, as depicted in FIG. 10*b*. As with the embodiments illustrated in FIGS. 9*a* and 9*b* of the drawings, the center portion of the control rod 79 is hollow, and is in open communication with the ink reservoir such that ink may flow to the writing tip 80 in a manner as heretofore described. Furthermore, an elastic membrane 86 (in phantom) may be secured to the bottom of the writing tip end 81 as with other embodiments which would be expanded and retracted in response to the movement of the writing tip 80.

Figure 11:
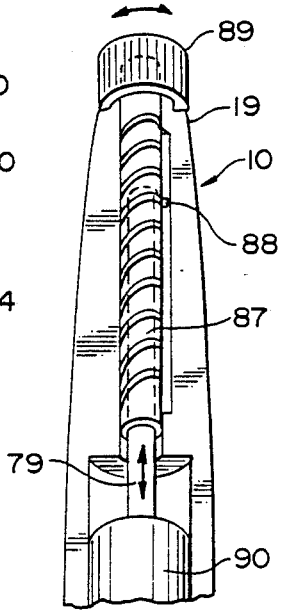
FIG. 11 illustrates the control means associated with the writing instrument as depicted in FIGS. 9a and 9b of the drawings, and illustrating the mechanical means of moving the control rod in a rotary motion.

FIG. 11 illustrates the manner in which the control rod 79 as demonstrated in embodiments 10*a* and 10*b* of the drawings may be manipulated to cause the reciprocating movement of the control rod 79 within the instrument 10. It will be observed that a spiral track 87 may be positioned within the upper barrel portion 19 of the writing instrument 10 and the control rod 79 may be provided with a control boss 88 which rides in the spiral track 87. A thumb grip 89 is provided at the top end of the instrument, and is designed to be rotably movable by the user thereof. The thumb grip 89 is fixedly secured to the control rod 79, such that when the grip 89 is rotably moved, the control rod will be similarly moved, and the control boss 88 will ride in the spiral track 87. Hence, as the control boss 88 rides upwardly or downwardly in the track 87, the control rod 79 will be moved either upwardly or downwardly in conjunction with the movement of the thumb grip 89. FIG. 11 further illustrates the fact that the control rod 79 is in communication with the ink reservoir 90, and is appropriately apertured (not shown) in order to allow ink to travel into the inner confines of the control rod 79 thereby to be in communication with the writing tip 80.

Figure 12A:
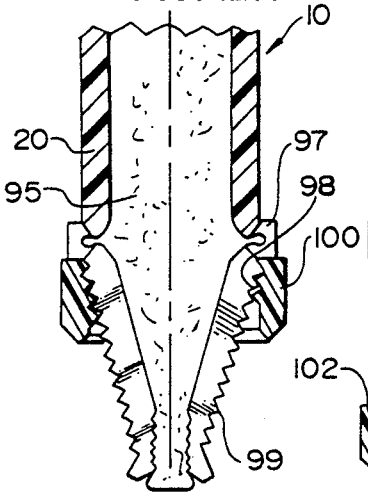
FIG. 12a is a side elevational view, in cross section, illustrating still another embodiment of the variable tip in accordance with the present invention wherein the writing tip is formed by a flexible filament including an extension portion extending outwardly from the writing end of the barrel and including a flexible arrest collar having flexing means associated therewith and showing the flexing means flexing the arrest collar to restrict the flexible filament into its smallest diametric dimension.
Figure 12B:
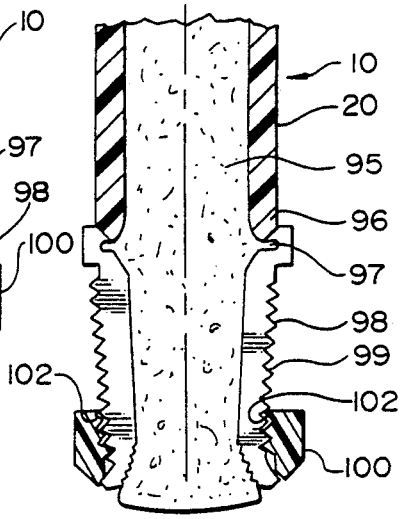
FIG. 12b is a side elevational view, in cross section, and partly broken away, showing the writing tip instrument of FIG. 12a, but with the flexing means adjusted to permit the maximum flex of the arrest collar such that the writing tip is in its maximum diametric dimensions.

FIGS. 12*a*, 12*b*, 12*a*', and 12*b*', respectively, still another alternate embodiment of the variable tip writing instrument is illustrated. In this embodiment, the lower barrel portion 20 of the instrument 10 is provided with at least one flexible filament 95 which is securely held within the lower end of the lower barrel 20. The writing tip end 96 of the lower barrel 20 is provided with a support shoulder 97 which supports an arrest collar 98 securely thereon. The arrest collar 98 is shown to be threaded as at 99, and carries thereon a flexing collar 100.

As more clearly shown in FIGS. 12*a*' and 12*b*', the arrest collar 98 is actually formed by a plurality of arrest collar segments 101 which are biasingly flexible toward and away from one another. It will be observed that the flex collar 100 is provided with internal threads 102 which matingly engage the threads 99 on the arrest collar 98. As is observed in FIGS. 12*a* and 12*a*' of the drawings, as the flex collar 100 is screw-threaded upwardly toward the writing tip end 96 of the instrument 10, the lower ends of the arrest collar segments 101 are forced into constricting arrangement, thereby flexing the flexible filament 95 into its minimum diametric dimension as particularly shown in FIG. 12*a*'. When the reverse rotary motion is applied to the flex collar 100, such that the flex collar 100 is screw-threadedly moved to the lowest position on the arrest collar 98, the arrest collar segments 101 biasingly unflex thereby unflexing the flexible filament 95 and permitting it to assume its largest or maximum diametric dimension as shown in FIG. 12*b*'. In this configuration, the writing tip presents the thickest possible dimension for writing purposes, whereas in the view shown in 12*a*', the flexible filament 95 is presented in its minimum diametric dimension which thereby accomplishes the variable positioning of the writing tip.

Figure 13A:
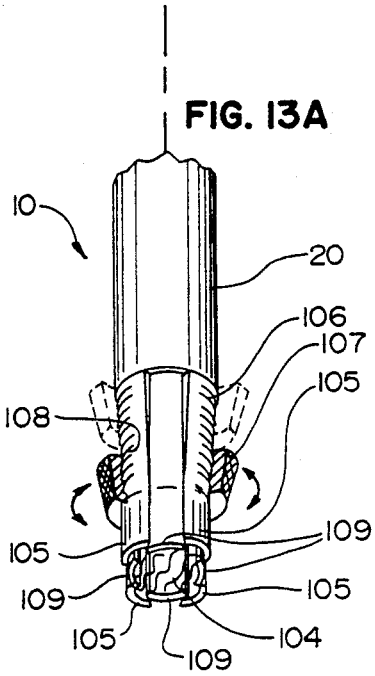
FIG. 13a is a side elevational plan view, illustrating still another alternate embodiment of the variable writing tip instrument of the present invention wherein the writing tip is formed by a plurality of distinct filament segments surrounded by a segmented arrest collar, and including a flexing means for flexing and unflexing the arrest collar, and showing the segmented filament in its maximum diametric dimension.
Figure 12A:
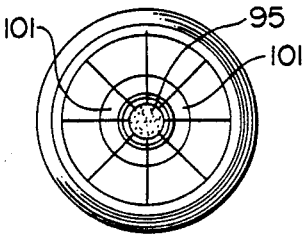
Figure 12B:
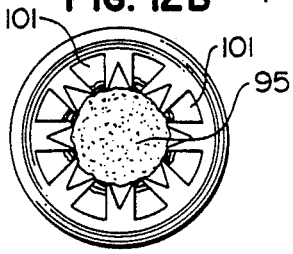
Figure 13B:
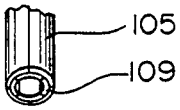
FIG. 13b is a broken away plan view showing the writing tip of the instrument as depicted in FIG. 13a, having the flexing means flexed to its smallest diametric dimension thereby causing a concomitant retraction of the segmented filaments into their smallest diametric dimension.

In FIGS. 13*a* and 13*b* of the drawings, a somewhat varied embodiment as shown in FIGS. 12*a* and 12*b* is illustrated. Once again, the instrument 10 is shown to be provided with a lower barrel portion 20 which terminates in a plurality of filament holding segments 105. The outer surfaces of the holding segments 105 are threaded as at 106, and there is further provided a flex collar 107 having internal threads 108 to be in mating engagement with the external threads 106 on the holding segment 105. The writing tip is formed by a plurality of filament segments 109 which extend slightly beyond the ends of the holding segments 105. It will be observed that the holding segments 105 are arranged to be in overlying relationship with respect to the filament segments 109 and further, that the holding segment 105 normally biasingly urge away from one another and in their normal position. Hence, as the flex collar 107 is screw-threaded upwardly toward the barrel 20, the lower ends of the holding segments 105 are biasingly urged into touching contact as illustrated in FIG. 13*b*, thereby bringing the filament segments 109 into their minimum diametric dimension and presenting the smallest writing thickness for the writing tip end of the instrument 10. When the flex collar 107 is screw threaded down along the length of the holding segments 105 to the lowest most point, the holding segments 105 biasingly flex outwardly, thereby permitting the filament segments, which are similarly flexible, to flex into their normal maximum diametric dimension and thereby present the thickest writing tip permitted by the instrument 10. It will therefore be appreciated that the ability to vary the tip end of the instrument may be easily adjusted simply by screw-threading the flex collar 107 along the length of the holding segments 105.

As with other embodiments, an elastic membrane 104 may be provided at the writing tip end overlying the filament segments 109 and secured to the holding segments 105 such that the membrane 104 is movable in response to the movement of the holding segments 105 and filament segments 109 respectfully.

Figure 14:
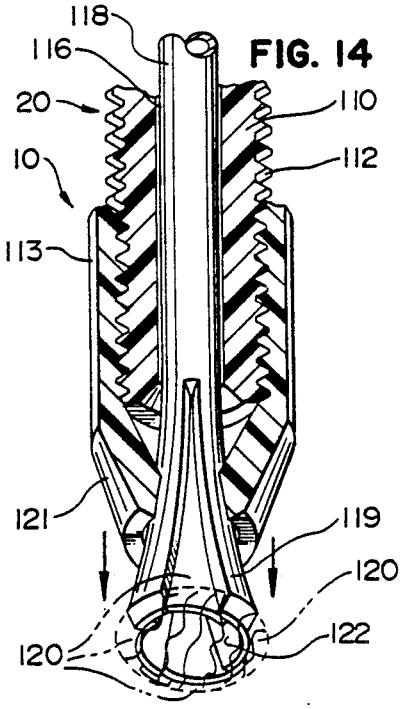
FIG. 14 is a side elevational view, in cross section, and partly broken away, showing a variable tip writing instrument as an alternative embodiment of the present invention, wherein the writing tip consists of a plurality of filament segments, the segments being arranged in a circular configuration and in sequential overlapping relation, and the control means adapted for vertical reciprocating movement with each of the filament segments being fixedly secured to a corresponding control rod segment and being reciprocated into the maximum diametric dimension thereof.

In FIG. 14 of the drawings, still a further embodiment of the invention is illustrated which is again, similar to the embodiment as depicted in FIG. 13*a* as well as FIG. 12*a* of the drawings. In this embodiment, the instrument 10 is shown to be provided with a lower barrel 20 which terminates in a threaded writing tip end 110 which is threaded as shown in 112. A flex collar 113 is provided having internal threads 114 adapted for threaded engagement with the threads 112 formed on the writing tip end 110. It will also be observed that the barrel 20 is cored as shown at 116, and contains an ink supply rod 118 extending through the core 116. The lower end of the ink supply rod 118 is provided with a plurality of supply rod segments 119 which are normally biasingly urged away from one another, and in this particular embodiment a series of four supply rod segments 119 are shown. It will be observed that writing filament segments 120 are positioned internally of the supply rod segments 119, each of the supply rod segments 119 being securely fixed to a corresponding filament segment 120.

It will further be observed that the lower end of the flex collar 113 is provided with a nose end 121 which functions to permit the unflexing of the supply rod segments toward and away from each other respectively as the flex collar 113 is screw-threaded up and down the length of the writing tip end 110. It is contemplated that the ink supply rod 118 and especially, the supply rod segments 119 forming the lower end thereof to be formed of a material whereby the segments 119 are normally biasingly urged in a spread apart configuration as shown in FIG. 14. Hence, as the flex collar 113 is screw-threaded up the length of the writing tip end 110, the supply rod segments 119 having the writing filaments 120 secured thereto are permitted to flex outwardly into their normal disposition, thereby causing the maximum diametric dimension of the writing tip to be exposed As the flex collar 113 is screw-threaded down the length of the writing tip end 110, the nose end 121 of the flex collar 113 flexes the supply rod segments 119 to engage in contact thereby to cause a concomitant flexing together of the writing filament segments 120 and present the smallest diametric dimension of the writing end of the instrument 10.

Again, an elastic membrane 122 may be provided secured to the supply rod segments 119 which would expand and retract in response to the movement of the rod segments 119 and filament segments respectively. As with the other embodiments described, the ink would travel through the filaments 120 and through the membrane 122 to effect the writing procedure.

Figure 15:
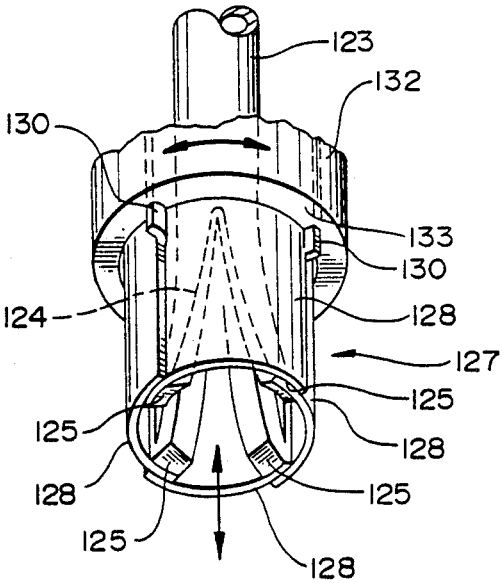
FIG. 15 is a side plan view of still an alternate embodiment of a variable tip writing instrument according to the present invention, wherein the writing tip is formed by a series of filament segments mounted within a segmented writing end of the instrument, the segmented writing end being capable of flex movement into and out of the maximum diametric dimension thereof by means of an arrest collar, and showing the writing tip in its maximum diametric dimension.

The embodiment as illustrated in FIG. 15 of the drawings presents a somewhat varied embodiment which operates in a very similar fashion to the embodiment as shown in FIG. 14. It will be observed that the ink supply rod 123 is again segmented as illustrated at 124 into a plurality of supply rod segments, each of the supply rod segments 124 terminating in writing tip segments 125. The lower barrel of the instrument 10 terminates in a shutter end 127, which consists, in this embodiment, of four overlapping shutter segments 128 respectively. The shutter segments 128 are shown to be in overlapping relationship one with respect to the next adjacent one, and each is shown to include a catch boss 130 adjacent the upper end thereof. A control collar 132 is provided at the top end of the shutter end 127, and includes a series of internal slots 133 in alignment with the catch bosses 130 formed on the shutter segments 128. The control collar 132 is adapted for rotary movement relative to the shutter end 127 of the instrument 10, and it will be appreciated that as the control collar 132 is rotated, the catch bosses 130 which are positioned within the internal slots 133 will rotate the shutter segments into a more tightly overlying relationship. The movement of the shutter segments 128 into a tight circle will cause a concomitant movement of the writing tip segments 125 into close unison, thereby presenting the minimum diametric dimension of the writing tip end, whereas the reverse rotary movement of the control collar 132 will open the shutter segments 128 to their furthest extant, and move the writing tips 125 into their maximum diametric dimension, thereby to, provide once again, a variable tip writing instrument.

Figure 16:
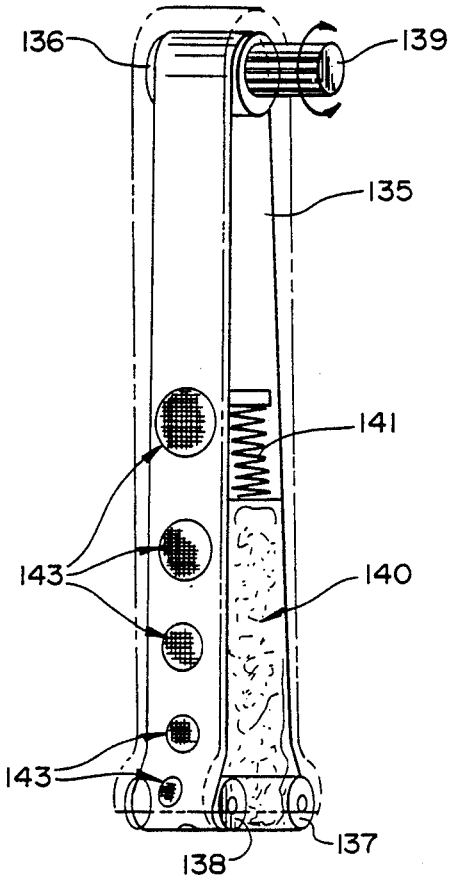
FIG. 16 is a side elevational view of still another alternative embodiment of a variable tip writing instrument according to the present invention wherein the writing tip is formed by at least one mask band formed as a continuous band and extending over vertically spaced rollers, the mask band including a plurality of variously sized writing apertures formed therein and adapted for operative positioning at the writing end of the instrument.

FIG. 16 illustrates still a further embodiment of a variable tip for a writing instrument in accordance with the present invention. As depicted therein, the lower barrel of the writing instrument (not shown) is provided with a continuous mask band 135 which is supported within the barrel by means of an upper shaft 136, and a pair of lower spaced apart shafts 137 and 138 respectively. The upper shaft 136 may be rotatably controlled by means of a control knob 139 thereby to cause a rotary movement of the shaft 136. In construction, the mask band 135 is frictionally fitted over the upper shaft 136 such that a rotational movement of the control shaft 136 causes a concomitant movement of the mask band 135.

In the embodiment as illustrated in FIG. 16, an ink supply reservoir in the form of an ink sponge 140 is carried within the lower confines of the lower barrel and held into the position by means of a mounted coil spring 141 such that the ink sponge 140 is in touching contact with the mask band 135 of the lower end thereof. It will be noted that the lower end of the mask band is supported between the spaced apart lower shafts 137 and 138 respectively such that the entire mask band 135, when rotated, is rotated over the upper shaft 136 and the spaced apart lower shafts 137 and 138. It will further be observed that the mask band 135 is provided with a plurality of variously sized apertures 143, each aperture being of a different diametric dimension. It will therefore be appreciated that as the control knob 139 is rotationally moved thereby to rotate the shaft 136, the mask band 135 will be moved in order to present a different diametric dimension of a writing aperture 143 at the lower end of the instrument and between the respective lower shafts 137 and 138. It will further be appreciated that in that position, the writing aperture 143 is in touching contact with the ink sponge 140 such that the ink is provided for writing purposes.

Figure 17:
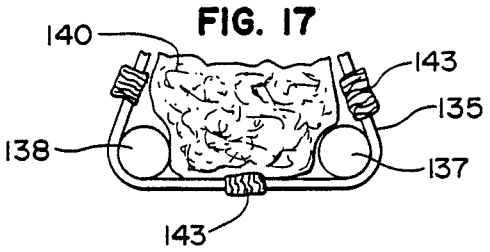
FIG. 17 is a side elevational view, partly broken away and in cross section, showing one of the apertures in operative position at the writing end of the instrument between the pair of horizontally spaced apart lower rollers and in communication with the ink supply.
Figure 18:
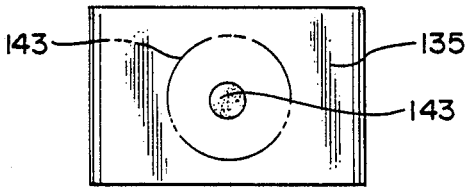
FIG. 18 is a bottom plan view of the writing tip instrument as depicted in FIGS. 16 and 17, showing the writing tip end of the instrument which would be in communication with a writing surface with one of the variously sized writing apertures in operative position.

FIG. 17 illustrates the positioning of one of the apertures 143 formed in the mask band 135 in writing position relative to the ink sponge 140. As shown in FIG. 18, one of the smaller writing apertures 143 is positioned at the bottom of the instrument and in writing position, while a larger writing aperture 143 is shown in phantom simply to illustrate the manner in which the various writing apertures can be moved into writing position.

Figure 19:
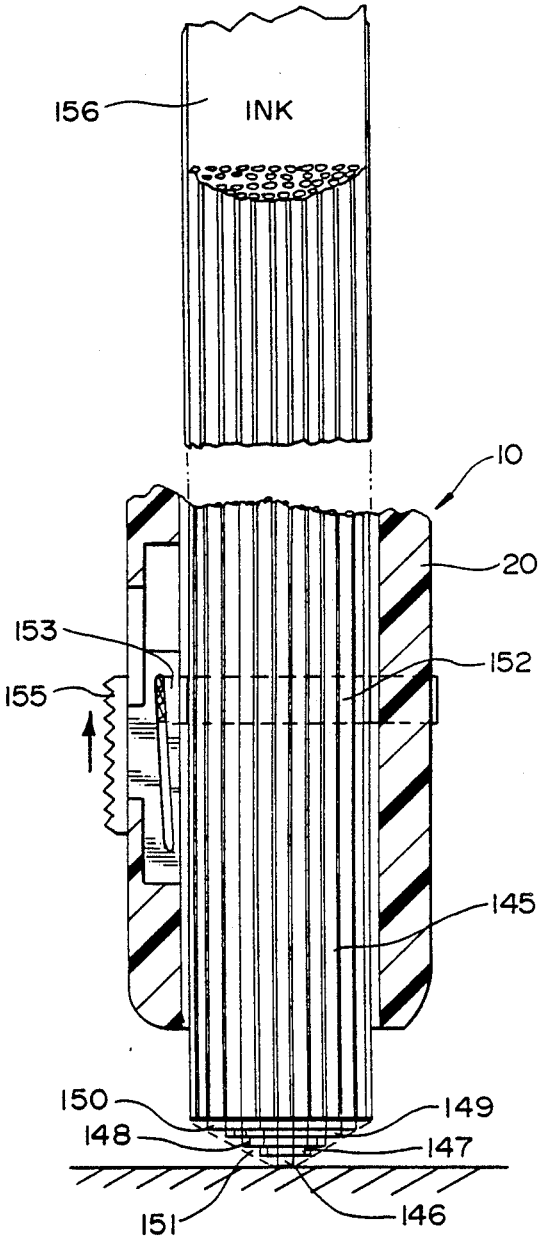
FIG. 19 is a side elevational view, partly broken away and in cross section, wherein the writing tip consists of a plurality of writing tubules, the tubules being arranged in concentrically oriented ringlet bundles, and having a single tubule forming the center of the concentric bundle, with each concentric ringlet bundle being in slightly raised position relative to the next successive ringlet bundle and further including a latch carried on the barrel and adapted to engage corresponding latch catches on each successive ringlet bundle thereby to vary the writing tip end of the instrument between the maximum and minimum dimensions thereof.

With respect to FIG. 19 of the drawings, still another alternate embodiment of a variable tip writing instrument in accordance with the present invention is illustrated. In this particular embodiment, the lower barrel 20 of the instrument 10 is shown to be provided with a plurality of concentrically arranged ringlet writing tubules 145 in telescopically arranged relationship. In the normal disposition, the center tubule 146 is presented as the writing tip end of the instrument and is obviously the smallest diametric dimension feasible with the instrument 10. Each of the remaining four bundles of ringlets of writing tubules 145 is held in a stepped and spaced disposition relative to the center tubule 146 by lock means to be described hereinafter. It will be observed that the center tubule 146 is surrounded with the next adjacent ringlet of writing tubules 147, forming the next diametric writing dimension for the writing tip, and similarly with respect to the next adjacent ringlet of writing tubules 148, and 149 and 150 respectively. It is contemplated that in this embodiment, as the user thereof desires to vary the writing tip end of the instrument to change the writing tip from the smallest to the medium or next adjacent thickness, the user need only press the point of the pen thereby to push the center tubule 146 upwardly, in order to expose and present the next ringlet of writing tubules 147 into writing position, and similarly with respect to each of the next adjacent ringlet of tubules 148, 149 and 150 respectively. It will be appreciated that any number of ringlet bundles may be employed in this embodiment, and that the illustration of four bundles is merely exemplary, and further other known mechanical means may be employed to eject and retract the tubules into writing contact.

In order to maintain each ringlet of writing tubules 145 in writing position, each of the ringlets is provided with a catch 152 formed therein, which operates in conjunction with a cam latch 153 formed along the lower portion of the lower barrel 20. As the instrument 10 is pressed downwardly such that the center tubule 146 contacts a lower support surface, the corresponding catch 152 is caused to ride out of the cam latch 153 until the cam latch 153 rides back into the next adjoining catch 152. The thumb push 155 is provided which the user may manipulate to force the cam latch 153 into locking relationship with the catch 152 of whichever ringlet of writing tubules 145 deemed necessary or desirable to form the writing tip end of the instrument 10. It will be observed that the upper end of the writing tubules 145 is in open communication with an ink reservoir 156 such that ink may be provided to the writing tip at all times. In this manner, a variable tip writing instrument 10 is provided by simply providing a plurality of ringlet of writing tubule bundles arranged in concentric orientation and in telescopic relation one with respect to the next.

Furthermore, this embodiment may further accommodate an elastic membrane 151 enveloping the writing tip tubules 147, 148, 149 and 150 for the purpose as previously described.

Figure 20:
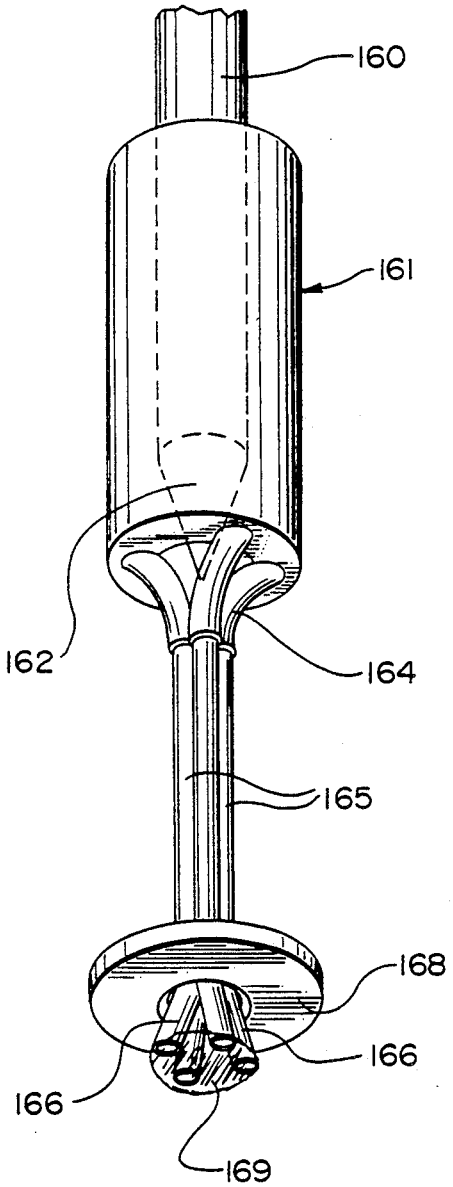
FIG. 20 is a side plan view, partly in cross section, showing still another alternative embodiment of a variable tip writing instrument and according to the present invention, wherein the writing tip consists of a plurality of filament segments extending downwardly from an ink supply, and having an extension portion and having a control rod which operates the writing tip by insertion between the plurality of filament segments located within the barrel of the instrument, and showing the extension portion in their maximum diametric dimensions.
Figure 21:
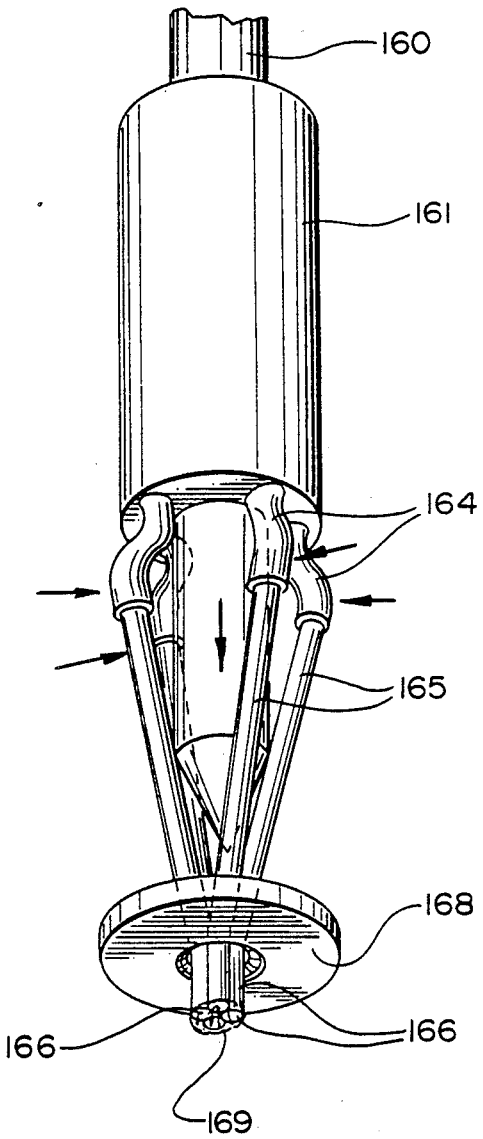
FIG. 21 is a side plan view of the writing instrument of FIG. 20, showing the control plunger in its fully extended position in order to spread apart the upper portions of the filament segments and thereby causing a concomitant retraction of the extension portions into their minimum diametric dimension thereof thereby to vary the writing tip end of the instrument.

FIGS. 20 and 21 illustrate still another embodiment of a variable tip writing instrument in accordance with the present invention. It will be observed that the lower barrel (not shown) is provided with a control rod 160 which is designed to travel within the inner confines thereof. Obviously, appropriate external control means such as that illustrated in FIG. 2*a* of the drawings may be provided at the upper end of the instrument 10 in order to control the reciprocating movement of the control rod 160. It will be observed that the control rod 160 passes through the ink reservoir cartridge 161, with the control rod terminating in a pointed nose 162. The lower end of the ink reservoir cartridge 161 is provided with a plurality of feeder tubes, FIG. 20 showing a series of four feeder tubes 164, each of the feeder tubes 164 accommodating a writing filament 165 fixedly secured thereto and extending downwardly therefrom. Each of the writing filaments 165 terminates in a writing end 166 as depicted in FIGS. 20 and 21. The support collar 168 is positioned at the lower end of the instrument 10 in order to support and maintain the writing tip end 166 in a secured disposition. As shown therein, the ink supply is maintained via the feeder tubes 164 to the writing filaments 165 and therefore, to the writing tip ends 166 thereof. It will further be noted that the writing tip ends 166 of the filaments 165 are formed of a material which causes the ends 166 to be normally biasingly urged away from each other as shown in FIG. 20. As shown in FIG. 21, as the control rod 160 is reciprocated downwardly, the pointed nose end 162 thereof enters the space between the corresponding feeder tubes 164 forcing the writing filaments 165 in a spread apart configuration above the support collar 168. This movement causes a concomitant movement of the writing tip 166 in the reverse direction such that the writing tips are now forced into a unison relationship thereby to present the minimum diametric dimension of the writing tip end of the instrument. As shown in FIG. 20, the reverse reciprocation of the control rod 160 causes the feeder tubes 164 to once again come together, causing a concomitant coming together of the writing filaments 165 and due to the normal biasing configuration of the writing tips 166, the same are caused to spread apart as illustrated therein.

Further, as shown in phantom in FIGS. 20 and 21, an elastic membranous material 169 may be secured to the writing tip ends 166 of the writing filament 165. Such a membrane 169 provides uniformity to the printed character and eliminates the possibility of line emissions during the writing process such that the imprinted lines or characters are uniform in terms of ink distribution. Where said membrane 169 is permeable or semi-permeable, it may also function to help control ink flow.

It will be appreciated that several of the embodiments as shown herein may be provided with an elastic membranous material similar to that shown above, to fulfill those purposes as described above. For example, the embodiments shown in FIGS. 2*a*, 2*b*, 3, 5*a* and 5*b*, 6*a* through 6*d*, 9*a* and 9*b*, 10*a* and 10*b*, 13*a*, 14, 15, 19 and 22, could be fitted with a membranous material overlying the tip end to create uniformity in the inked characters. Such a membranous material would be reasonably elastic and could be permeable or semi-permeable with respect to the ink material.

Figure 22:
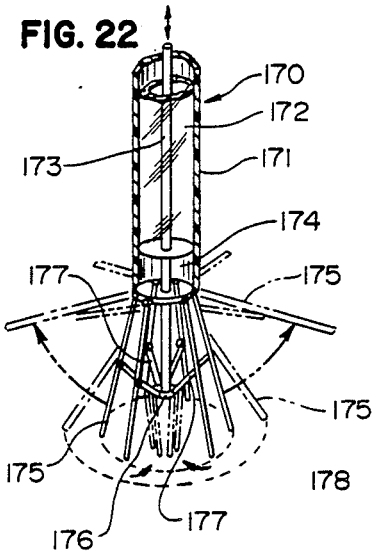
FIG. 22 is a plan view, partly broken away and partly in cross section, showing the writing tip end of an alternative embodiment of the subject instrument wherein the writing tip as formed by plurality of membrane support rods supporting a porous membrane structure at the lower ends thereof to form the writing tip, and being hinged at the opposed end relative to the control means, and also including intermediate hinged pivots to effect the control of the angular disposition of the membrane support rods as the control means is manipulated into and out of the writing instrument.
Figure 23A:
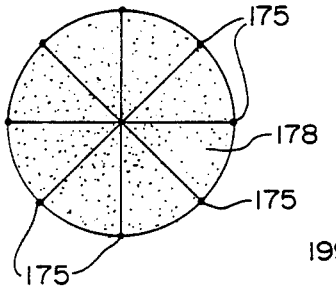
FIG. 23a is a top view showing the membrane and associated membrane support rods of the writing instrument of FIG. 22 in their fully extended position.
Figure 23B:
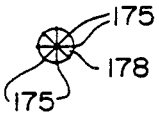
FIG. 23*b* is a top view showing the membrane and the associated membrane support rods in their fully retracted position illustrating the smallest writing tip end of the instrument depicted in FIG. 22.

FIGS. 22, 23*a* and 23*b* illustrate still another alternate embodiment of a writing instrument according to the present invention. Shown therein, the writing instrument 170 includes a barrel 171 which functions as the ink reservoir 172 in the manner illustrated with respect to other embodiments. A control rod 173 extends upwardly through the barrel 171, to an appropriate control mechanism preferably at the upper end of the instrument (not shown), and downwardly terminates in a control head 174 which will vertically reciprocate with the control rod 173. The control head 174 is shown to include a plurality of membrane support rods 175 which are hingedly connected to the control head 174 at the upper end thereof as illustrated. It will further be observed that the control rod 173 extends through the control head 174, and terminates at a hinge ring 176. Each of the support rods 175 is shown to be further hingedly secured to the hinge ring 176 by means of a plurality of hinge rods 177 such that the hinge rods 177 are hingedly secured to the support rods 175 at one end, and to the hinge ring 176 at the opposed end thereof.

The writing tip is completed by means of an expandable membrane 178 which is fixedly secured to each of the support rods 175 along the periphery thereof. As shown in FIGS. 23*a* and 23*b* respectively, as the control rod 173 is reciprocated downwardly, the support rods 175 are forced out of the barrel 171, and by the hinging action accompanying the hinge rods 177 as hingedly secured to both the hinge ring 176, and the support rods 175, are forced into their furthest extant to create the largest diametric dimension writing tip as illustrated in FIG. 23*a*. As the control rod 173 is vertically retracted upwardly, such that the control head 174 is withdrawn into the instrument barrel 171, the support rods 175 are caused to retract to their smallest diametric dimension as withdrawn into the barrel 171 thereby creating the writing tip as illustrated in FIG. 23*b*. It will be appreciated that the description contained above clearly indicates that the writing tip of the instrument shown in FIG. 22 is intended to operate much in the same fashion as an inverted umbrella in terms of the opening and closing of the writing tip end thereof. Hence, in this manner, the variable writing tip in accordance with the scope of the present invention is provided.

FIGS. 24, 25*a*, 25*b* and 25*c* illustrate still another embodiment of the present invention pursuant to which a variable tip writing instrument may be provided. As shown therein, the writing instrument 180 again includes a barrel 181, which terminates at the lower writing tip end. The writing tip end includes a rotatable collar 182 which overrides the barrel 181, and is shown to be provided with a plurality of shutter blades 183 at the lower end thereof. The blades 183 are pivotally secured to the rotatable collar 182, and are designed to operate in the same manner as a camera shutter, or iris diaphragm, or lens light controlling device, which is well known in the art. Positioned immediately above the shutter blades 183 is an ink sponge 184 which is forced against the shutter blades 183 by means of a sponge plate 185, and the coil spring 186. The coil spring 186 is shown to be interposed between the sponge plate 185, and the lower end of the barrel 181. If desired, an ink reservoir may be positioned in the barrel 181, and be in fluid communication with the ink sponge 184 by tubules or by any appropriate means commonly known in the art.

The shutter blades 183 may be provided with an elastic membrane 188 attached thereto, interposed between the blades 183 and the ink sponge 184 thereby to expand as the blades 183 are opened and contract when the blades 183 are closed. The membrane 188 is sufficiently elastic to expand and retract through the writing aperture 187 as the shutter blades 183 are operated.

Figure 25A:
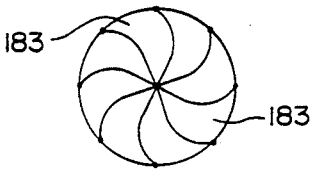
FIG. 25*a* is a bottom view of the instrument as shown in FIG. 24, with the writing tip in its fully closed position.
Figure 24:
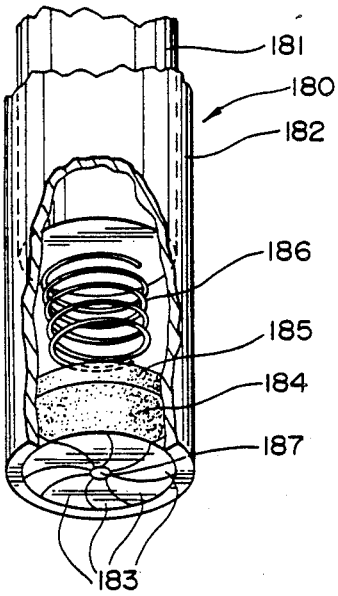
FIG. 24 is a side elevational view, partly in cross section, illustrating still another embodiment of the writing tip end of an instrument according to the present invention, wherein the writing tip is formed by a plurality of shutter blades having a porous material disposed thereabove, such that the porous material may expand through the shutter opening to form the writing tip end, and illustrating the manner in which the writing tip may be varied between the largest and smallest diametric dimensions thereof.
Figure 25B:
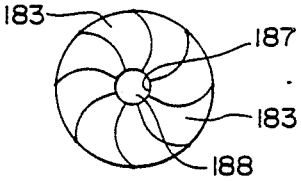
FIG. 25*b* is a bottom view showing the writing tip of the instrument shown in FIG. 24, with the shutter blades partially opened to expose a small writing tip.
Figure 25C:
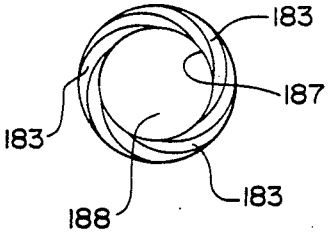
FIG. 25*c* is a bottom view of the writing tip of the instrument shown in FIG. 24, showing the shutter blades fully open to expose the maximum diametric dimension of the writing tip end.

As shown in FIGS. 25*a* through 25*c*, as the rotatable collar 182 is rotated, the shutter blades 183 are caused to either open or close thereby varying the writing aperture 187 to vary the same between the smallest diametric dimension as generally shown in FIG. 24, to the largest diametric dimension as depicted in FIG. 25*c*. FIG. 25*a* is intended to illustrate the shutter blades 183 in their closed off position such that no writing aperture is available. In this manner, the blades 183 close the instrument to prevent ink leakage therefrom. FIGS. 25*b* and 25*c* show the smaller and larger diametric dimensions of the writing aperture 187 respectively.

It is also contemplated that an appropriate retraction mechanism may be employed with respect to the ink sponge 184 to withdraw the ink sponge from the writing aperture 187 as the shutter blades 183 are rotated to the closed position. It is contemplated that from a mechanical standpoint, the sponge plate 185 may include threads, for example, which can be thread-matingly keyed to internal threads provided on the interior surface of the rotatable collar 182. In this manner, as the collar 182 is rotated in one direction, the sponge plate 185 is moved downwardly against the ink sponge 184 to force a portion thereof through the writing aperture 187, while the reverse movement will effect a withdrawal of the ink sponge 184 from the writing aperture 187 as the shutter blades 183 are closed.

Figure 26A:
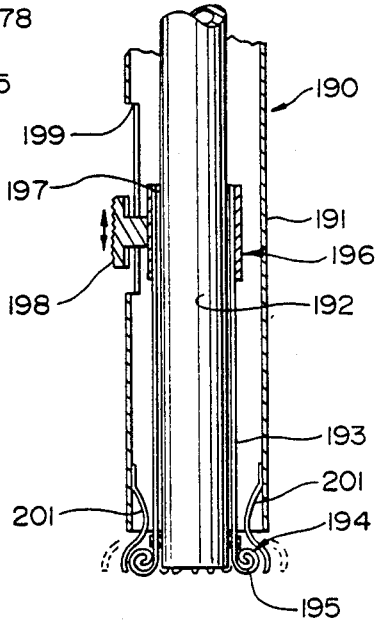
FIG. 26*a* is a side elevational view, in cross section, showing still another alternate embodiment of a writing instrument according to the present invention, wherein the writing tip is formed by an expandable hose-like membrane which rolls and unrolls into a cuff thereby to vary the diametric dimension of the writing tip end between the largest and smallest diametric dimensions, and showing the writing tip end in its larger extant.
Figure 26B:
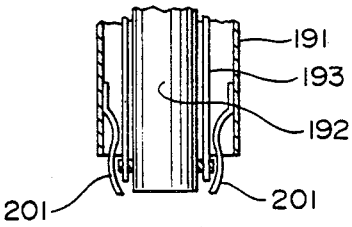
FIG. 26*b* is a side elevational view, in cross section and partly broken away, showing the hose-like membrane of the writing tip end of the instrument in FIG. 26*a*, in its withdrawn position exposing the minimum diametric dimension thereof.

With respect to FIGS. 26*a* and 26*b*, still another alternate form of a writing instrument is depicted. As shown therein, the writing instrument 190 is formed by a barrel 191, which includes an ink reservoir 192 therein. The ink reservoir 192 is tubular in construction, and is provided with a porous membrane 193 circumferentially positioned thereabout. The lower end of the membrane 194 is shown to be adapted to curl into a cuff 195 in response to the movement of the control means 196. The control means consists of a control collar 197 which overrides the tubular ink reservoir 192, and in manipulated by means of a thumb push 198 which extends through a slotted portion 199 of the barrel 191.

The lower end of the barrel 191 is provided with a plurality of curvilinear leaf springs 201 which function to aid the cuffing of the membrane 193 to form the cuff 195 as illustrated in FIG. 26*a*. In operation, as the control collar 197 is reciprocated downwardly, the membrane 193 is forced downwardly, such that the cuffing action of the lower end of the membrane may commence, thereby to form a rolled cuff 195 as illustrated. It will further be appreciated that as the cuff 195 is forming, the leaf springs 201 are caused to expand outwardly, thereby exposing the greatest diametric extant of the writing tip.

Figure 27:
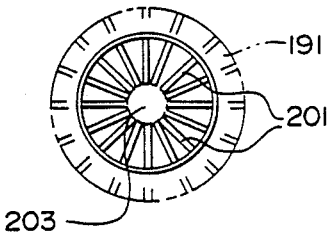
FIG. 27 is a bottom view of the writing tip end of the instrument shown in FIG. 26*b*, with the writing tip in a smaller diametric dimension thereof.

As shown in FIG. 26*b*, when the thumb push 198 is pushed upwardly thereby pushing the control collar 197 upwardly, the membrane 193 is in effect pulled upwardly, thereby reversing the cuffing action, and causing the cuff to become smaller in dimension thereby reducing the size of the writing tip end. As shown in FIG. 27, when the membrane has been fully withdrawn into the barrel 191 of the instrument 190, the leaf springs 201 are the only elements exposed, thereby eliminating any writing tip from exposure through the writing aperture 203.

Figure 28:
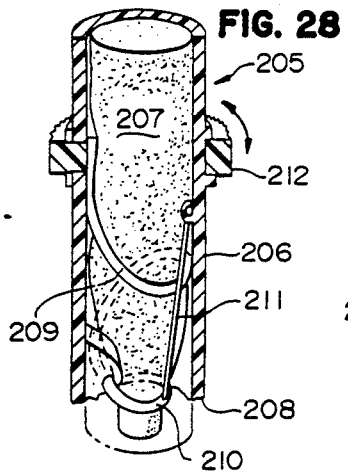
FIG. 28 is a side elevational view, partly in cross section, showing still another alternate embodiment of the writing instrument according to the present invention, wherein the writing tip is formed by a resilient solid tube, which may be constricted by a constrictor varied between a wide tip and a narrow tip.

FIG. 28 illustrates still a further embodiment of the variable tip writing instrument wherein the writing instrument 205 includes a barrel 206 in which is contained a spongy membranous material 207 which extends beyond the tip end of the barrel 208. Surrounding the spongy membrane 207 is a constrictor cord 209 in the form of a helix, which terminates at a lower end 210, which is in turn secured to the interior portion of the barrel by securing rod 211. The upper end of the constrictor cord 209 is fixedly secured to a rotatable thumb screw 212. It will be appreciated that as the thumb screw 212 is rotated in a counterclockwise direction, the constrictor cord is loosened, which thereby permits more of the spongy membrane material 207 to exit from the tip end 208 of the barrel 206 exposing a greater diametric dimension of the writing tip. Alternatively, as the thumb screw 212 is rotated in a clockwise direction, the constrictor cord 209 will constrict thereby constricting the spongy membrane 207 and presenting a smaller diametric dimension of the writing tip to the exposed tip end 208 of the barrel 206.

Figure 29:
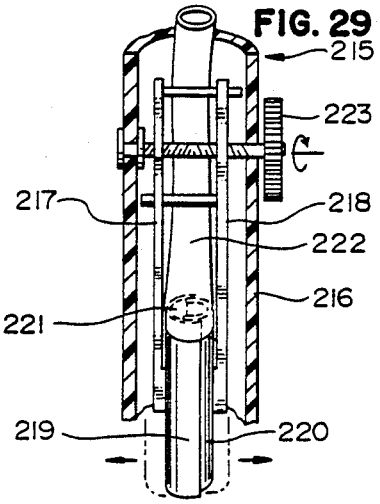
FIG. 29 is a side elevational view, partly in cross section, showing still another alternate embodiment of the writing instrument of the present invention wherein the writing tip is formed by a spongy material carried within a pair of elongated U-shaped clasps, which may be constricted or enlarged by an appropriate tightening mechanism as disclosed.

FIG. 29 represents an additional embodiment of the subject invention wherein the writing instrument 215 again includes a barrel 216. Within the confines of the barrel 216 is a pair of control rods 217 and 218 respectively which, at the lower ends thereof, encase a pair of c-shaped clamps 219 and 220 respectively. A spongy membrane material 221 is contained within the confines of the respective c-shaped clamps 219 and 220 to which ink is fed by an ink supply line 222. The control rods 217 and 218 are horizontally moveable with respect to one another and adapted to move toward and away from each other by means of a threaded thumb screw 223, which in turn, controls the movement of the c-shaped clamps 219 and 220 respectively. It will be appreciated that as the control rods 217 and 218 are moved horizontally apart, a greater diametric dimension of the spongy membrane material 221 is exposed at the tip end creating the widest writing line, whereas alternatively, the movement of the control rods 217 and 218 toward one another constricts the c-shaped clamps 219 and 220 respectively, thereby constricting the spongy membrane material 221 to present the thinest writing line.

Figure 30:
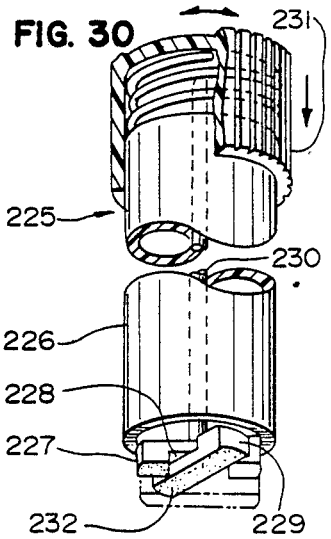
FIG. 30 is a side elevational view, partly in cross section, showing still another alternate embodiment of a writing instrument of the present invention wherein the thickness of the printed line may be varied by arcuately manipulating the tip in order to vary the line thickness from thin to thick.

FIG. 30 illustrates still another alternate embodiment of a variable tip for a writing instrument. The writing instrument 225 includes a barrel 226 which has the writing tip at the lower end thereof. In this instance, the writing tip consists of a fixed brace 227 which is formed with a u-shaped slot 228 formed along the horizontal extant thereof. An arcuately moveable brace 229 is designed to seat within the u-shaped 228, and is arcuately moveable into and out of horizontal alignment with the fixed brace 227 by means of control rod 230. The control rod 230 is in turn, manipulated by means of a threaded control cap 231 which operates to arcuately move the moveable brace 229. It will be appreciated that when the moveable brace 229 is in horizontal alignment with the fixed brace 227 by being positioned within the u-shaped slot 228, the writing line is at its thinest extant. When the moveable brace is moved out of horizontal alignment into the position shown in FIG. 30, by manipulating the threaded control cap 231, a wider line is created in order to permit the variation of the writing tip to its largest diametric dimension. It will be observed that the bottoms of the fixed brace 227 and moveable brace 229 are provided with spongy membranous material 232 which are fed by an ink supply in the same manner as heretofore disclosed with other embodiments.

Figure 31:
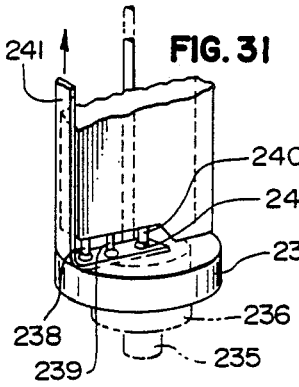
FIG. 31 is a side elevational view, partly in cross section, showing an alternate embodiment of the writing instrument of the present invention wherein the writing tip is again telescopically arranged thereby to vary the writing tip, by raising and lowering consecutive concentric writing tiplets.

With respect to FIG. 31, an alternative embodiment of a writing tip instrument is illustrated. The writing instrument contains a barrel (not shown) in which the lower tip end is provided with a variable writing tip of the type disclosed. In this instance, the variable writing tip is formed by providing a series of concentrically arranged membranous material tips 235, 236, and 237 respectively, each of which is fed by a separate ink supply tube 238, 239, and 240 respectively. The ink supply control rod 241, which is semi-flexible and vertically moveable is provided with at least one aperture 242 at the end thereof such that by movement of the ink supply control rod 241, the aperture 242 may be positioned under any one of the respective ink supply tubes. It will be appreciated that when the aperture 242 is, for example, positioned under the ink supply tube 240, supplying membrane 235, only membrane 235 will be inked, and the line will be at its smallest diametric dimension. If, on the other hand, the aperture 242 is positioned by movement of the control rod 241 under the ink supply tube 238, then the membrane 237 will be inked, and upon downward pressure being applied on the writing tip, or by movement of an internal control mechanism (not shown), membranes 235 and 236 will actually form a part of the overall writing membrane tip of 237, and the largest diametric dimension tip is then presented.

Figure 32:
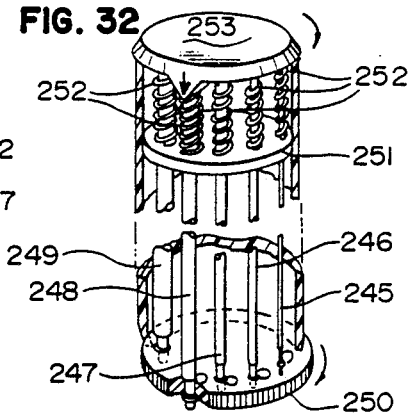
FIG. 32 is a side elevational view, partly in cross section, showing an alternate embodiment of the writing instrument of the present invention wherein a plurality of writing tips are provided each writing tip designed to be separately manipulated into position, the writing tips varying from very thin to very thick.

In FIG. 32, variable writing tip is provided by providing a series of variously sized writing tiplets, 245, 246, 247, 248 and 249 respectively, the tip ends of which are contained within an appropriately apertured bottom plate 250. The upper ends of the writing tiplets are each held in position by holding plate 251 and held in fixed position therein by means of coil springs 252. An upper setting cap 253 is provided, which is rotatable and moveable between the writing tiplets 245 through 249 respectively, thereby to select and position the respective tiplet desired into its writing mode. This is accomplished by rotating the upper cap 253 to the desired tiplet, and causing the extension of the tiplet through at least one aperture in the bottom plate 250 to expose the writing tip. If desired the apertured bottom plate 250 may be made rotational to select and position the desired tiplet.

Figure 33:
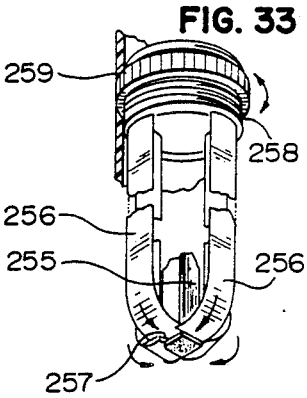
FIG. 33 is a side elevational view, partly in cross section, showing still another alternate embodiment of a writing instrument in accordance with the present invention wherein the writing tip is formed by a compressible tubule controlled by a series of four constrictors which may alternately be manipulated to constrict or release the writing tip to vary the same between a fine tip and a thick tip.

In FIG. 33, the variable tip is created by providing a central spongy membrane writing tip 255 which is positioned within a series of four substantially l-shaped holding legs 256, in which a central aperture 257 is positioned through which the writing tip 255 is exposed. The upper ends of the l-shaped holding legs 256 are fixed to a threaded collar 258 which is moveable within a fixed threaded ring 259. It will be appreciated that as the fixed threaded ring is rotated, the threaded collar 258 will either rise upwardly or downwardly causing either a greater or smaller amount of the spongy writing tip 255 to be exposed through the central aperture 257. As more of the writing tip 255 is exposed by having the l-shaped holding legs ride upwardly along the writing tip, a wider diametric dimension of the writing tip will be exposed thereby providing a wider writing tip. The reverse action will cause a thinner or smaller writing line to be exposed thereby causing the variance in the writing tip. It is deemed to be within the scope of this embodiment to provide constrictor legs which may be more or less in number than the four legs as shown.

Figure 34:
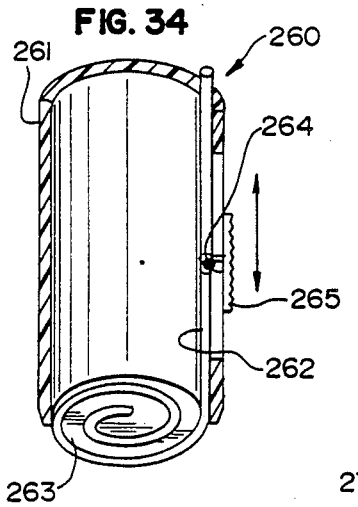
FIG. 34 is a side elevational view, partly in cross section, wherein the writing tip is shown to be constructed in the form of a coil which may be coiled and uncoiled by means of a control mechanism thereby to vary the writing tip from a thin to a thick tip.

FIG. 34 illustrates still a further embodiment of the present invention wherein the writing tip of the instrument is, once again, contained within the barrel 261 of writing instrument 260. The variable tip is constructed by having a control cord 262 which is in the form of an internal spiral within the barrel 261. The control cord 262 has fixedly secured thereto the sponge membrane material 263 which is fed by an ink supply source (not shown). The control cord 262 is fixedly secured to a control lever 264 which is operated by thumb control 265 such that upon the upward vertical manipulation of the thumb control 265, the control cord 262 is pulled more tightly inwardly thereby decreasing the amount of sponge membrane material 263 exposed at the tip end of the writing instrument 260, or upon the manipulation thereof, increases the amount of sponge membrane material 263 available as a writing tip. As an alternative version, the cord 262 may be a covering material to cover or expose less or more of the writing material contained thereunder when manipulated by the control 265. In this version, the downward manipulation of the control 265 decreases the amount of sponge material 263 available as a writing tip, while the reverse action increases the writing tip. In this manner, the variable writing tip may be easily and manually controlled.

Figure 35:
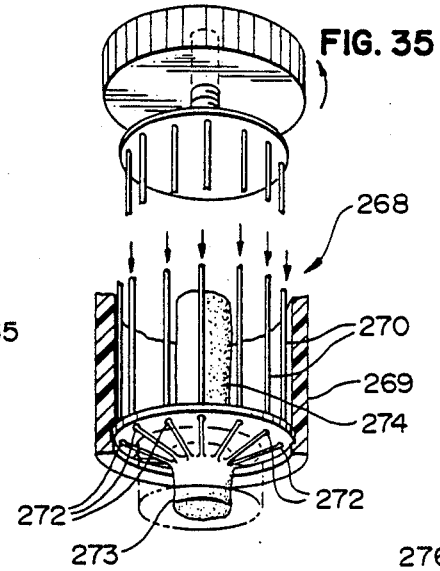
FIG. 35 is a side elevational view, partly in cross section, showing still another alternate embodiment of a writing instrument in accordance with the present invention wherein the writing tip is formed from a compressible tubular material which is encased by a permeable membrane which may be alternately drawn tighter or looser around the tip thereby to vary the tip from a thin to a thick tip.

FIG. 35 illustrates still a further embodiment of the subject invention wherein the writing tip instrument 268 is again contained within a barrel 269, the variable writing tip consisting of a plurality of elastic cords 270 which exit through a bottom plate 271 through a plurality of apertures 272 and terminate in a permeable membrane 273. A core of sponge material 274 is contained within the barrel 269 and within the permeable membrane 273. It will be appreciated that as the elastic cords are relaxed, the permeable membrane 273 will increase in size thereby increasing the diametric dimension of the variable tip of the sponge material 274 within the permeable membrane 273 to increase the thickness of the imprinted line. The retraction of the elastic cords 270 will constrict and retract the core of sponge material 274 into a more narrow tip, thereby decreasing the diametric dimension of the tip.

Figure 36:
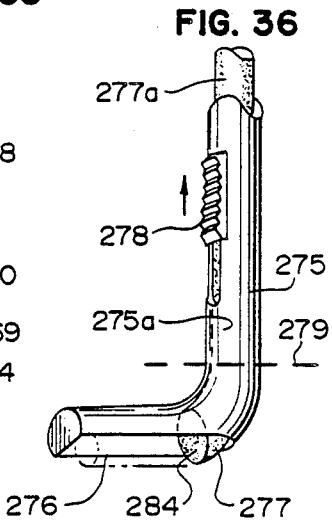
FIG. 36 is a side elevational view, partly in cross section, of a writing instrument in accordance with the present invention wherein the writing tip is formed by an L-shaped tubule containing therein a movable compressible filament, the lower end of the L having an open slot to accommodate increasing portions of filament which thereby varies the tip from a thin tip to a thick tip depending upon the amount of filament presented to the open channel.

As shown in FIG. 36, the variable tip may be accomplished by providing an l-shaped tubular member 275 which is shown to be provided with an open slotted end 276 at the lower writing tip end thereof. Contained within the tubular member 275 is a core of sponge material 277 which is controlled by a vertically oriented thumb control 278. It will be appreciated that as a greater volume of the core of sponge material 277 is manipulated into the open slotted end 276 of the tubular member 275, a greater or lesser amount of writing surface is presented to the tip end of the writing instrument. The sponge material 277 may be provided with a cord 277*a* fixedly secured thereto which rides within a slot 275*a* within the tube 275 to hold the sponge material 277 in place when exposed in the open slotted end 276. The end of the sponge material 277 may be provided with a cap 284 secured thereto to prevent the sponge material from drying out when not in use.

As further shown in FIG. 36, the writing instrument depicted therein may be modified by eliminating the l-shaped portion of the member 275 along the dotted line 279 such that the instrument consists of a straight tubule member 275. In this version, the sponge material 277 is extracted from the lower end of the tubule 275, the variable nature of the writing tip being dependent upon the amount of sponge material 277 extruded from the bottom of the tubule 275 at line 279.

Figure 37:
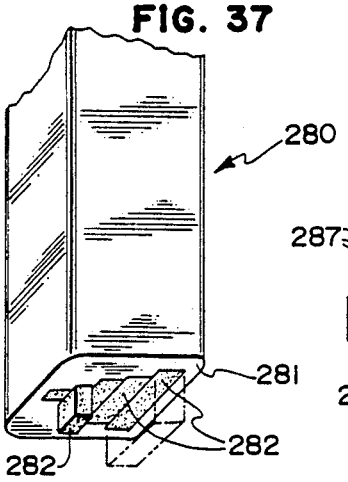
FIG. 37 is a side elevational view showing still another alternate embodiment of a writing instrument in accordance with the present invention wherein the writing tip is formed by a plurality of tip members which may be alternately lowered into writing position, each tip presenting a consecutively larger thickness in order to accommodate varying of the tip thickness.

FIG. 37 illustrates another embodiment wherein the variable writing tip is again controlled by means of a plurality of writing tips which may be vertically manipulated into the writing position. As shown therein, a series of at least two writing tips are contained within the tip end 281 of the writing instrument 280 and are manipulable in a vertical direction. The writing tips 282 may be vertically manipulated into a writing position in order to cause the variance of the thickness of the writing tip end of the instrument 280. As is illustrated in FIG. 37, each writing tip 282 is of a varying diametric dimension such that a desired width for a writing tip may be selected by the user and manipulated into the writing posture by means of a control rod (not shown).

Figure 38:
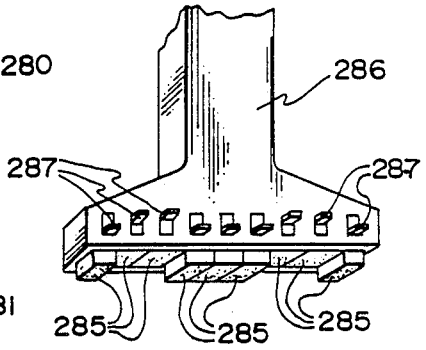
FIG. 38 is a side elevational view showing still another alternate embodiment of a writing instrument in accordance with the present invention wherein the tip is formed by a plurality of tip ends, each of which may be separately manipulated to be lowered into writing position, the thickness of the tip being dependent upon the number of tips engaged into their writing position.

FIG. 38 shows still another alternate embodiment wherein the writing tip end of the instrument is formed by a plurality of similarly sized writing tips 285 which are set within a casing 286. Each writing tip 285 is vertically positionable within a writing or non-writing position by simply utilizing control levers 287 which may be manipulated between a writing and a non-writing position. This may be accomplished manually, or by some automatic feature otherwise well-known in the art, but not shown in FIG. 38.

Upon selection of the desired number of writing tips 285 into the writing position, the thickness of the imprinted line character may be varied and controlled.

FIG. 39 once again shows another alternative embodiment wherein the writing instrument 290 is contained within a barrel 291, the variable tip being formed by an elastomeric member 292 which has fixedly secured to the outside parameter thereof the spongy membrane material 293. The elastomeric member 292 is connected at its top end to a control mechanism 294 which is screw threadedly contained within the barrel 291 such that upon downward screw threading of the control member 294, the elastomeric member 292 is pushed downwardly and expands the sponge membrane material 293 outwardly thereby to increase the diametric dimension of the writing surface. The upward movement of the elastomeric member 292 causes the sponge membrane material 293 to retract upwardly thereby decreasing the diametric dimension thereof, thereby causing the variableness in the tip.

Figure 39:
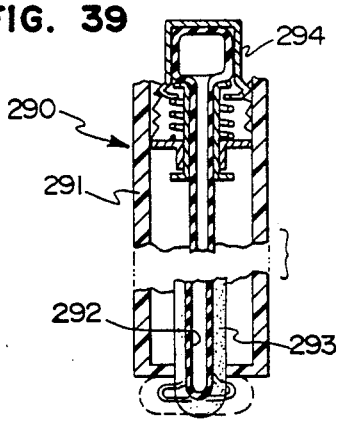
FIG. 39 is a side elevational view, in cross section, showing still another alternate embodiment of a writing instrument in accordance with the present invention, wherein the writing tip is formed by a U-shaped tubular element which is controlled by a screw-member which operates to alternately expand or retract the tip thereby to vary the line thickness between thin and thick.

As an alternative version of the embodiment shown in FIG. 39, the control mechanism 294 may be adapted by controlling a fluid under pressure contained within the confines of the elastomeric member 292 such that upon applying pressure against the fluid, the fluid pressure will force the spongy membrane material 293 to expand outwardly from the tip end of the instrument, in balloon fashion, thereby increasing the writing thickness of the tip end of the instrument. The reverse action would cause the tip end to constrict thereby narrowing the line thickness of the character to be imprinted.

Figure 40:
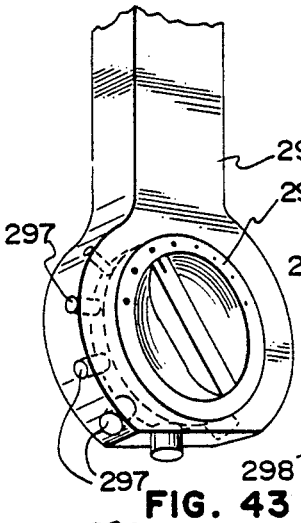
FIG. 40 is a side elevational view, partly in cross-section, showing still another alternate embodiment of a writing instrument in accordance with the present invention wherein the writing tip includes a plurality of tips which may be manipulated into writing position by turning the tip carrier in order to expose the desired tip end, the various tip ends varying in size between very thin and very thick.

FIG. 40 again illustrates still a further embodiment of the invention wherein the variation of the writing tip is created by providing a tip wheel 295 which is contained in casing 296 and may be manipulated either manually, or by some form of a control mechanism. As illustrated in FIG. 40, the tip wheel 295 includes a plurality of differently sized diametrically arranged tip ends 297 which may be manipulated into the writing tip end of the instrument by simply turning the tip wheel 295. As shown in FIG. 40, each of the tip ends is of a varying diametric dimension such that the desired writing tip end may simply be arcuately moved into the writin position.

Figure 40A:
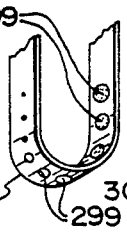
FIG. 40*a* is a side elevational view, wherein the writing tip of FIG. 40 may be varied by providing a moving band containing a series of openings varying between a very small diametric opening, and a very large diametric opening, the band moving around a filament material located internally thereof, such that the tip end may be varied by selecting the proper aperture in the band to expose filament material therethrough and vary the tip ends.

FIG. 40*a* is intended to show a slight variation of the embodiment as shown in FIG. 40 such that a single writing tip may be provided at the end of the casing 296, and the variation of the writing tip may simply be controlled by manipulating a band 298 which contains a plurality of variously sized diametric apertures 299 which may be manipulated into the writing position by simply moving the band 298 into the desired position.

Figure 41:
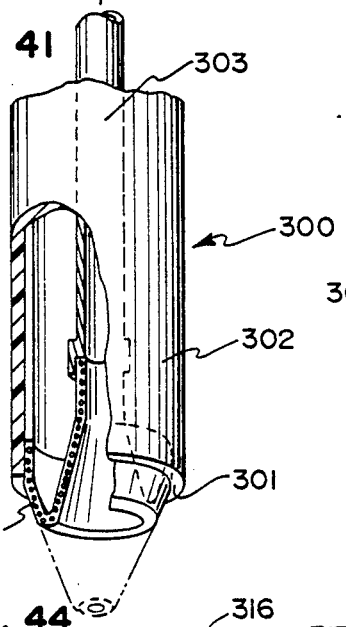
FIG. 41 is a side elevational view, partly in cross section, showing still another alternate embodiment of a writing instrument in accordance with the present invention wherein the writing tip is formed by an inverted resilient filament material controlled by a control rod, the tip size being varied by alternately reciprocating the control rod along a vertical axis thereby to expose an alternately larger or smaller writing tip.

FIG. 41 illustrates still a further embodiment of a variable writing tip instrument wherein the variation in the writing tip is caused by providing a control mechanism within the tip end 301 of the writing instrument 300, the tip end 301 being contained at the bottom end of the barrel 302. The diametric variation in the writing tip is caused by providing a control rod 303 which is secured to an elastomeric permeable membrane 304 which may expand or contract depending upon the manipulation of the control rod 303. The elastomeric permeable membrane is interconnected with an ink supply in the manner as previously described herein with other embodiments, such that the membrane may be inked at all times. In this embodiment, the elastomeric permeable membrane 304 is folded in an inverted or v-shaped manner such that the control rod 303 controls the size of the v-shaped writing tip thereby to cause variations in the writing tip thickness.

It will be appreciated that as the control rod 303 is moved in the downward position, the elastomeric permeable membrane 304 is extended into the smallest diametric dimension thereby decreasing the diametric dimension of the writing tip and as the control rod 303 is moved upwardly, the diametric dimension of the tip end increases thereby maximizing the thickness of the writing end of the instrument.

Figure 42:
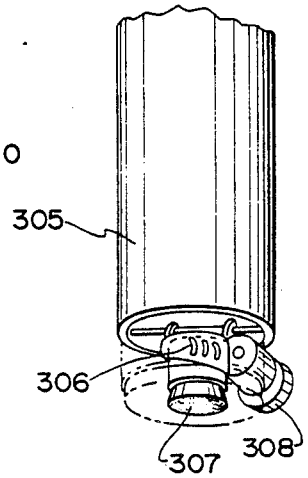
FIG. 42 is a side elevational view, partly in phantom, wherein the writing tip is formed by a compressible filament material the thickness of which is controlled by a clamp member which may be alternately tightened and loosened in order to vary the amount of filament material available for a writing tip end, and thereby vary the writing tips.

FIG. 42 again illustrates an alternate embodiment wherein the variable writing tip is again contained within the barrel 305 of the writing instrument and is comprised of a clamp member 306 which encircles the sponge membrane material 307 as illustrated. The clamp member 306 includes a control member 308 which may be manipulated to either constrict or expand the clamp member 306. It will be appreciated that as the clamp member 306 is either expanded or constricted as illustrated, the amount of sponge membrane material 307 available as a writing tip is either increased or decreased accordingly. In this manner, the variation of the writing tip may be accomplished.

Figure 43:
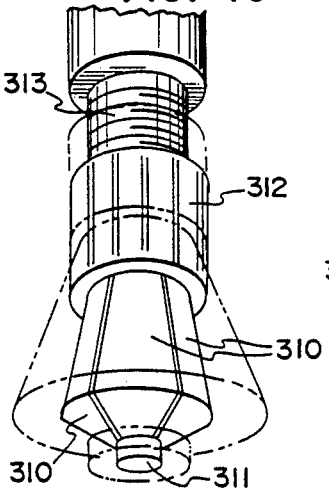
FIG. 43 is a side elevational view, partly in phantom, showing still another alternate embodiment of a writing instrument in accordance with the present invention, wherein the writing tip is formed by a compressible filament material carried within the confines of a tip claw, surrounding the filament material, which when released from the writing barrel, expands in order to permit the filament material to expand to create a thick line, and when retracted, retracts to restrict the filament material thereby to create a thin line.

FIG. 43 illustrates still another embodiment which operates to control the variation of the writing tip. Once again, the writing tip is contained within a barrel (not shown) and is formed by a series of tip claws 310 which carry within the confines thereof the sponge expandable membrane material 311 as illustrated. The tip claws 310 are controlled by a collar 312 which is screwed threadedly fitted onto a screw threaded shaft 313 such that when the collar 312 is screw threadedly operated up or downwardly on the screw threaded shaft 313, the tip claws 310 will alternately open and close. It will be appreciated that as the claws open, a greater amount of the sponge material 311 is exposed to the writing tip end thereby increasing the size of the writing tip end. The reverse action will decrease the amount of sponge material available thereby varying the tip end of the instrument.

Figure 44:
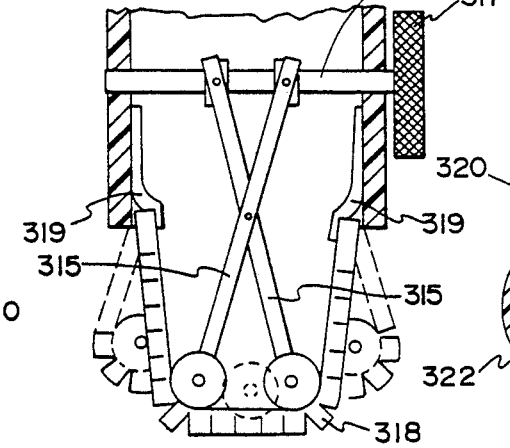
FIG. 44 is a side elevational view, partly in cross section, showing still another alternate embodiment of a writing instrument of the present invention, wherein the writing tip consists of an expandable membrane material controlled by a pair of control rollers which are designed to expand along a horizontal axis, to an enlarged position thereby creating a wide line thickness, or retracted to their narrowest point to create the thinnest line thickness.

FIG. 44 illustrates still a further feature of the invention which accomplishes a variable writing tip end which, once again, is positioned within the tip end of a barrel of a writing instrument and is formed by providing a pair of pivoting rods 315 which are secured to a threaded shaft 316 at their upper end, the threaded shaft being controlled by a thumb screw 317. The pivoting rods 315 are enveloped by an expandable membrane 318 which is secured within the barrel of the writing instrument by means of clamps 319, or other fastening means. As is illustrated therein, as the pivoting rods 315 are moved apart from one another, the degree of expandable membrane 318 available as a writing surface is increased thereby increasing the diametric dimension of the writing surface, whereas the reverse action will cause the writing surface of expandable membrane 318 available as a writing tip to decrease.

Figure 45:
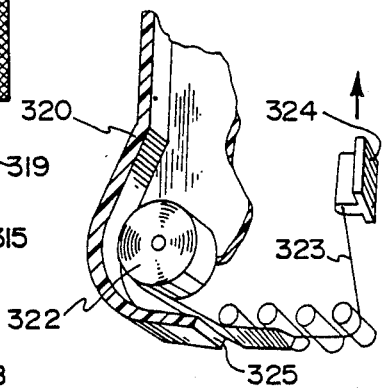
FIG. 45 is a side elevational view, in cross section, and partly broken away, which illustrates still another alternate embodiment of a writing instrument of the present invention, wherein the thickness of the writing tip may be controlled by exposing to the tip end greater or lesser amounts of the writing membrane which is contained on a spool located within the writing tip barrel, and which is exposed by a control line to alternately pull or retract the writing membrane from the writing roller.

FIG. 45 shows still a further alternate embodiment wherein the expandable nature of the writing tip within the barrel 320 is created by providing a roll of inked permeable membrane 322 which is connected by means of a control cord 323 to a control mechanism 324. The tip end of the barrel 320 includes a slotted portion 325 which will expose a portion of the roll of membrane 322 to the open slotted portion 325 forming the writing tip end. As the control mechanism 324 is manipulated upwardly, the control cord 323 draws a greater portion of the membrane material 322 into the slotted portion 325 in order to vary the amount of membrane material available for varying the writing tip end of the instrument. The reverse action of the control mechanism 324 will decrease the amount of material 322 exposed within the slotted portion 325 and hence, decrease the diametric dimension of the writing tip.

Figure 46:
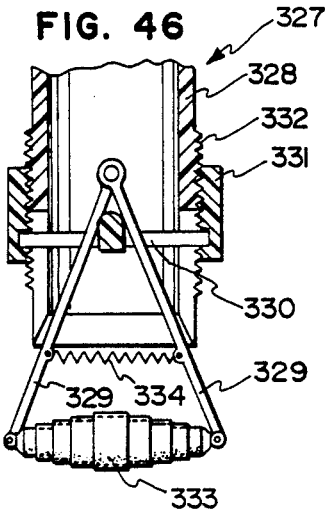
FIG. 46 is a side elevational view, partly in cross section, of still another alternate form of a variable writing tip instrument of the present invention, wherein the writing tip consists of an expandable membrane material carried between a pair of opposed rods totally secured at their upper end, the distance between the rods being controlled by the degree of rod lengths extending from the writing tip end of the barrel such that the writing filament may be alternately expanded to its largest extant to create a wide line, or retracted to its smallest extant to create the fine line writing tip end.

FIG. 46 shows still another embodiment of controlling the variation of the writing tip wherein the writing instrument 327 includes a barrel 328 in which the variable writing tip is located. In this instance, the variable tip is accomplished by providing a pair of pivoted rods 329 which are held in position by a control plate 330. The control plate 330 is contained within a threaded cap 331 which screw threadedly is contained on the barrel 328 along a screw threaded portion 332 thereof. The outer ends of the pivoted rods 329 are fixedly secured to a telescopically controlled spongy membrane material 333 which is adapted to be expandable or retractable depending upon the positioning of the pivoted rods 329. The rods are intended to be normally held in an expanded position by means of an expansion coil spring 334 which will spread the pivoted rods 329 into an outward direction as the control plate 330 is moved downwardly by unscrewing the threaded cap 331 along the screw threaded portion 332. The reverse action will cause the pivoted rods 329 to retract, thereby retracting the telescopic membrane 333 into a lesser diametric dimension hence, control the variation of the writing tip. Inking of the sponge material 333 may be accomplished by providing ink pathways through the rods 329, or enveloping the tip with a permeable membrane as described with respect to other embodiments.

Figure 47:
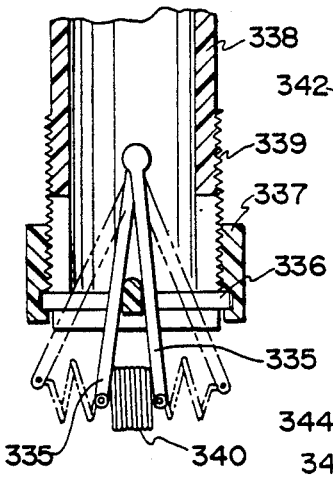
FIG. 47 is a side elevational view, partly in cross section, showing still another alternate form of the writing tip instrument as generally shown in FIG. 46, wherein the writing tip is created by a coiled filament connected to the two exposed ends of the control rods, writing filaments being designed to expand, accordion style to their largest extant, or constricted to their smallest extant by the control rods to create a fine line writing instrument.

FIG. 47 illustrates another alternate form of controlling the variation of the writing tip, once again, utilizing a pair of pivoted rods 335 which are carried on a control plate 336. Control plate 336 again is carried within the confines of an external threaded cap 337 which operatively moves up and down the barrel 338 along the threaded portion 339 thereof. The writing tip end is in the form of an elastic material 340 which, as previously indicated is in intimate contact with an ink source (not shown). As the pivoted rods 335 move outwardly, the coiled sponge material 340 will move outwardly thereby increasing the writing surface. The reverse action causes a diminishment of the diametric dimension of writing surface available thereby causing a variation in the writing tip end.

Figure 48:
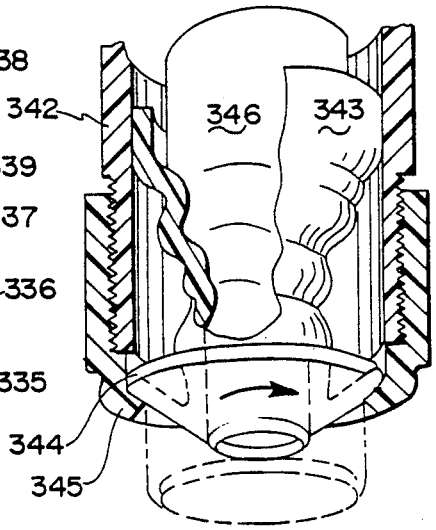
FIG. 48 is a side elevational view, partly in cross section, showing still another alternate embodiment of a writing instrument of the present invention, wherein the variable tip is created by a flexible substantially cone-shaped flexible casement, containing therein a spongy membrane material, the cone casement being integral with a circular tip end having a central aperture therein, such that when the cone casement is moved upwardly, a greater degree of the sponge membrane will be exposed through the central aperture thereby to widen the tip, where as the reverse motion will constrict the sponge membrane thereby to narrow the tip end.

FIG. 48 again shows another embodiment wherein a variable tip may be achieved. In this instance, the barrel 342 containing an inner casement 343 is fixedly secured to a lower apertured controlled plate 344 which is vertically moveable along the barrel 342 by means of a screw threaded cap 345 which overrides the control plate 344. A mass of sponge membrane material 346 is contained within the inner casement 343, and extends through the apertured portion of the lower control plate 344. It will be appreciated that as the lower apertured control plate 344 is screw threaded upwardly by means of manipulating the cap 345 on the barrel 342, a greater portion of the sponge membrane material 346 will be exposed through the aperture, thereby increasing the diametric dimension of the writing tip. The reverse action will decrease the amount of sponge membrane material 346 appearing through the apertured control plate 344 and decreasing the thickness of the writing character.

Figure 49:
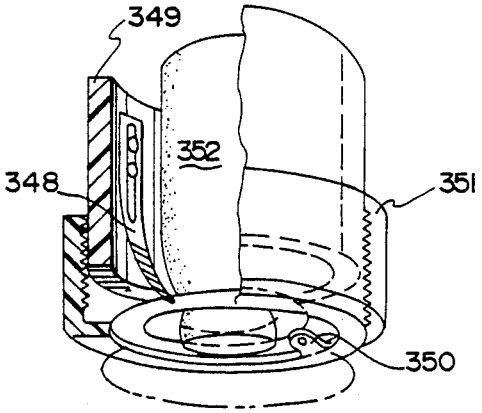
FIG. 49 is a side elevational view, partly in cross section, showing still another alternate embodiment of a writing instrument of the present invention, wherein the writing tip may be varied between a thin and thick tip by a fixed noose arrangement, the noose circumventing the spongy membrane writing tip, which when relaxed, exposes the maximum tip end as a writing tip, and when constricted, exposes the narrowest writing tip end of the sponge membrane.

FIG. 49 illustrates another mechanical version of the present invention wherein the variable writing tip of the instrument is accomplished by means of having a spiral control rod 348 secured to the inside portion of the barrel 349. The opposed end of the spiral control rod 348 is secured to the tip end 350 of the writing tip barrel 349. The tip end 350 of the instrument is fixedly secured to an outer collar 351 which screw threadedly operates on a threaded end of a the barrel 349. It will be appreciated that as the screw threaded collar 351 is manipulated either upwardly or downwardly along the barrel 349, the spiral control rod 348 will constrict or release more or less of the sponge membrane material 352 through the lower end of the writing tip end as illustrated in FIG. 49. As the outer collar 351 is screw threaded in the clockwise direction, that is, downwardly, the degree or amount of sponge membrane material 352 available for a writing tip end is decreased thereby decreasing the diametric dimension thereof. The reverse action will increase the amount of sponge membrane material 352 available thereby causing the variation in the writing tip.

Figure 50:
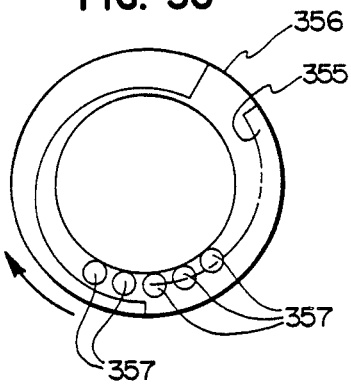
FIG. 50 is a bottom plan view showing still another alternate embodiment of a writing instrument of the present invention wherein the writing tip may be varied between a wide and a thin tip end, by providing an angular slide way which when arcuately turned, will expose more or less of a number of tip ends fixedly secured to the bottom of the instrument, such that the tip thickness may be varied by the arcuate movement of the barrel.

FIG. 50 illustrates still a further mechanical alternative wherein the variable writing tip end is achieved by providing an angularized raceway 355 carried on the lower end of a screw threaded cap at the tip end of the barrel 356. A plurality of elastic ink tubules 357 are carried at the tip end of the writing instrument and extend through the raceway 355 for a short distance. As the angularized raceway 355 is turned in a clockwise direction, the widest portion of the raceway is exposed thereby relieving any tension from the elastic ink tubules 357 thereby permitting all of the ink tubules to function as the writing tip end. As the raceway is turned in a counterclockwise direction, the increasingly narrowing portion of the raceway will strike against each of the tubules in sequential fashion. As each inked tubule 357 is pinched, the ink supply thereto is cut off, thereby decreasing the writing tip by one tubule in sequential fashion. It will be appreciated that when the narrowest portion of the raceway 355 is in pinching relationship with all of the inked tubules 357, all of the tubules will be pinched off thereby cutting off the ink supply to all tubules 357. Hence, the angularized raceway gives the operator the ability to control the number of inked tubules 357 to be exposed feeding the writing tip.

Figure 51:
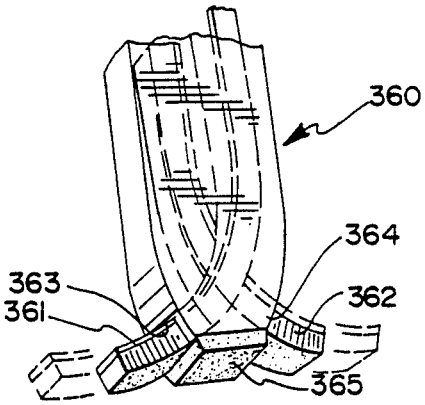
FIG. 51 is a side elevational view, partly in cross section, showing still another alternate variable tip writing instrument of the present invention, the writing tip end consisting of a pair of opposed writing membranes, which may be alternately extruded from the writing tip end, or retracted therein, which will thereby vary the line thickness.

FIG. 51 illustrates another mechanical version of accomplishing a variable tip instrument wherein the writing tip end of the instrument 360 includes a pair of flexible sponge members 361 and 362 respectively. Each of the flexible sponge members 361 and 362 is carried within the writing instrument 360 within appropriate channels provided, and exit through appropriate apertures 363 and 364 respectively. At the lower end of the writing instrument 360 is carried the smallest diametric dimension of a writing tip 365 which may be expanded by control means (not shown) which will force greater portions of the flexible sponge members 361 and 362 outwardly through the apertures 363 and 364 respectively to increase the writing surface as depicted in FIG. 51. The control mechanism for expanding or retracting the flexible sponge members 361 and 362 may take any one of the mechanical versions as heretofore illustrated.

Figure 52:
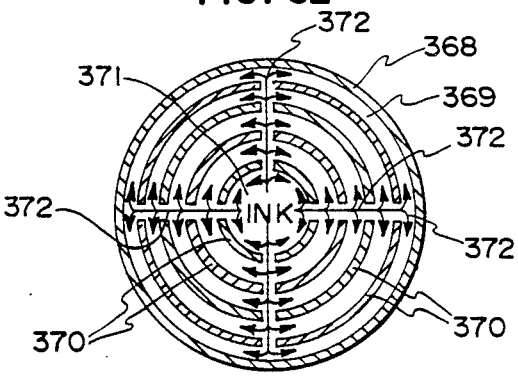
FIG. 52 is a bottom plan view showing a writing tip of still another alternate embodiment of a writing instrument of the present invention wherein the tip thickness is controlled by a plurality of ink pathways, the degree with which the ink is impressed into the pathway as being a function of the member of pathways which are opened, thereby to vary the tip between a thin and a thick width.

FIG. 52 of the drawings again illustrates another embodiment wherein the lower writing tip end 368 is formed by providing a series of concentrically oriented sponge membranous circular tips 369 which are separated by a plurality of concentrically oriented spacer walls 370. The center portion of the writing tip end 368 provides the main pathway, generally depicted by the numeral 371. Each of the concentrically oriented spacer walls 370 is shown to be provided with a plurality of ink apertures 372 which provide ink pathways through the spacer walls 370 to ink various of the concentrically oriented sponge membranes 369. In one version of this embodiment, the variation of the writing tip is caused by the downward manual pressure of the writing tip instrument on the underlying surface, a squeegee effect is realized such that the greater the pressure, ink is forced through a greater number of ink pathways and the inking of the writing tip will increase from the center outwardly. In an alternate version of this embodiment, the spacer walls 370 are rotatable one with respect to the other, such that when the same are oriented as shown in FIG. 52, with all of the ink apertures 372 in alignment, all ink pathways are then open such that ink will flow from the center or main ink pathway 371 to the outer most extreme sponge member 369. Each pathway, however, may be closed off by rotating one or more of the spacer walls 370, by control member (not shown), thereby to decrease the size of the writing tip by shutting off increasing numbers of the concentrically oriented sponge members 369.

Figure 53:
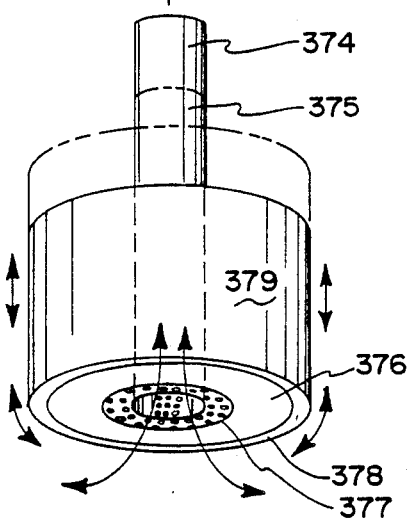
FIG. 53 is a side elevational view, partly in cross section, showing still another alternate embodiment of the present invention, wherein the writing tip may be varied between a thin and a thick width, by providing a membrane forming the writing tip which includes the inner poreous section, and an outer nonporeous section, the inner poreous section being connected to a center tubule, which is reciprocable along a vertical axis, such that when the inner tubule is retracted upwardly, a small degree of the poreous portion of the membrane is exposed thereby to narrow the writing tip, and when reciprocated downwardly, a greater percentage of the poreous portion of the membrane is exposed thereby to thicken the tip width.

FIG. 53 again represents another alternative embodiment wherein the variation of the variable tip is attained by providing the centerally disposed ink supply tube 374 in which is contained an elastic membrane 375 which is in a tubular format, the lower end of which is formed from a non-porous material as depicted at numeral 376 and the upper portion of which is formed from a porous material as depicted at numeral 377. The lower end of the writing tip instrument is provided with a base plate 378 which is fixed at the lower end of the instrument, over which the elastic tubular membrane 375 is stretched. The outer end of the elastic tubular membrane 375 is securely fastened to a surrounding collar 379 which is vertically moveable upwardly and downwardly along the lower end of the writing instrument. It is contemplated that the non-porous of the membrane 376 will not accept ink, and therefore when the non-porous portion of the membrane 376 is exposed over the base plate 378, the instrument is prevented from any writing function. As the surrounding collar 379 is pulled upwardly relative to the instrument, the elastic tubular membrane 375 is pulled downwardly and out across the base plate 378 until the porous portion of the membrane 377 is exposed around the center ink supply tube 374. It will be appreciated that as the surrounding collar 379 is moved further upwardly along the length of the writing instrument, a greater portion of the porous portion of the membrane 377 will be exposed over the base plate 378 thereby increasing the diametric dimension of the character to be imprinted. It will therefore be appreciated that the variation of the writing tip is caused by alternately exposing more or less of the porous portion of the membrane 377 over the base plate 378 by the manipulation of the surrounding collar 379.

As an alternate version of this embodiment, the base plate 378 could be perforated, in order to allow ink to pass there through, and the interior portion of the collar 379 could be provided with an inked spongy material (not shown) which would form the ink supply. Hence, as the porous portion of the membrane 376 is pulled over the base plate 379 over a greater number of the apertures formed therein, the thickness of the imprinted characters would increase.

Figure 54:
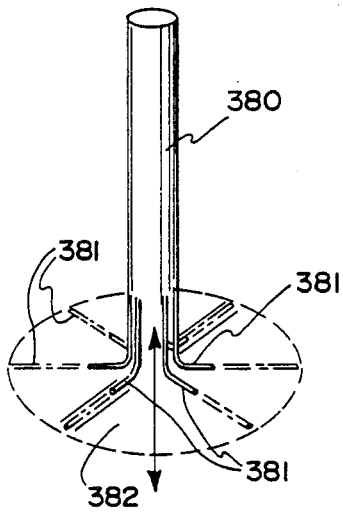
FIG. 54 is a side elevational view, showing still another alternate embodiment of the variable writing tip in accordance with the present invention, wherein the writing tip consists of a plurality of writing tubules having an expandable writing membrane secured thereto, which may be extracted out from the center tubule thereby to expose a greater length of the tubules and writing membrane to form the writing tip end and widen the tip, or retracted into the center tubule thereby to expose a lesser length of the writing tubules and narrow the writing tip end.
Figure 54A:
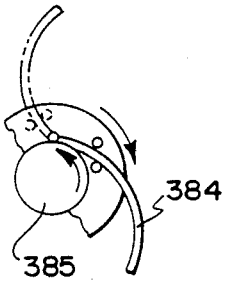

FIG. 54 shows another alternate embodiment of the mechanical versions available for increasing or decreasing the tip end of a writing instrument. In this instance, a supply tube 380 is provided within the barrel (not shown) in which is contained a plurality of writing tip cords 381 which are vertically moveable within and without the supply tube 380. It will be appreciated that as greater lengths of the writing tip cords 381 are pushed forwardly and out of the supply tube 380, the overall diametric dimension of the writing tip will increase, while the reverse action will decrease the diametric dimension of the writing tip end. As another alternative version, the writing tip cords 381 may be secured to an expandable porous membrane 382 to form the writing tip, which expands or contracts as the cords 381 are moved in and out of the tube 380.

Figure 55:
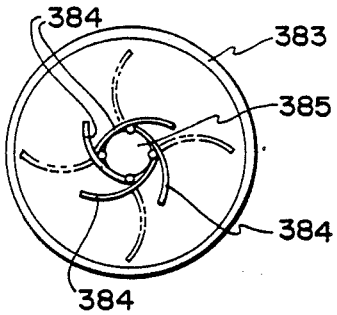
FIG. 55 is a bottom plan view showing still another alternate embodiment of a variable writing tip instrument of the present invention, wherein the writing tip is formed by a series of four arcuate writing fingers pivotally mounted at the writing tip end, such that as the writing fingers are pivotally moved to their outer most extant, the writing tip is expanded to provide a thick line, whereas when they are pivotally moved to their smallest extant, the smallest writing tip end is presented.

FIGS. 55 and 55*a* depict still another alternate mechanical version in order to accomplish a variable tip writing instrument. In this case, the barrel 383 contains within the confines thereof a plurality of pivotly secured writing tips 384, which are pivotly secured to an inner control tube 385 in the manner illustrated. Hence, manipulating the inner control tube 385 in a clockwise direction will throw the pivotal writing tips out to their furthest extant, while manipulation in a counterclockwise direction will pull the writing tips 384 into their most restricted diametric dimension, hence, varying the writing tip ends of the instrument. Obviously, appropriate ink supply lines are provided to the writing tips 384 in order to complete the creation of a variable writing tip instrument.

Figure 56:
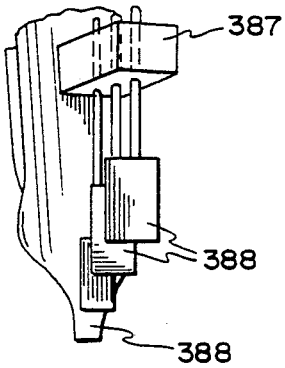
FIG. 56 is a side elevational view of still another alternate embodiment of a variable writing tip in accordance with the present invention, wherein the writing tip varies by providing a plurality of different sized tip ends, each of which may be separately extended or retracted into writing position thereby to vary the line thickness.

FIG. 56 illustrates still a further embodiment wherein the variable writing tips are achieved by having a writing tip block 387 mounted within the interior confines of the barrel (not shown), and having fixedly secured thereto a series of increasingly diametrically enlarged writing tips 388 secured thereto. The writing tips 388 and control block 387 to which the same are affixed are adapted for vertical manipulation within the confines of the barrel, such that as the same is downwardly depressed, greater diametric dimensions of the writing tips 388 will appear at the writing tip end of the barrel thereby increasing the thickness of the line to be imprinted.

Figure 57:
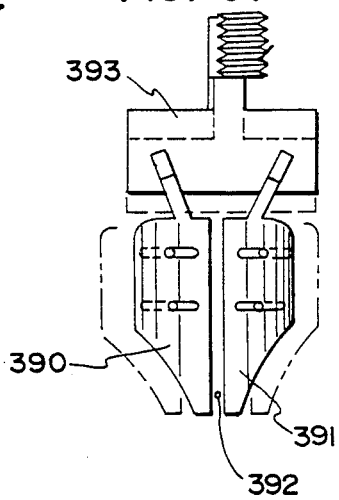
FIG. 57 is a side elevational view, partly in cross section wherein the writing tip is formed by a pair of jaws containing a membrane material therebetween, the jaws being movable between a fully opened position thereby to expose the maximum membrane as a writing tip and forming the thickest writing line, or retracted to their narrowest extant thereby exposing a small amount of membrane material therethrough thereby to form the thinnest writing line.

FIG. 57 illustrates still a further embodiment of a mechanical achievement of a variable writing tip instrument, wherein the writing tip end is provided with a pair of moveable jaws 390 and 391 respectively in which is contained a mass of sponge membrane material 392. The respective moveable jaws 390 and 391 are carried within a block 393 in a piston-cylinder arrangement such that upon the downward movement of the jaws 390 and 391, the jaws are forced together, thereby decreasing the amount of membrane material 392 available for the writing surface. The reverse movement of the jaws 390, 391 will open the jaws and increase the amount of membrane material 392 available as a writing surface, thereby causing the variation of the writing tip end.

Figure 58:
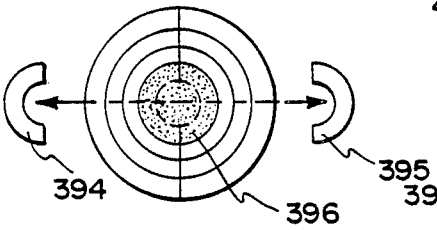
FIG. 58 is a bottom plan view showing still another alternate embodiment of a variable writing tip in accordance with the present invention wherein the variable writing tip is formed by a pair of opposed C-shaped clamp members, which may be moved alternately between a closed and opened position, relative to one another, with a writing membrane being interposed therebetween, such that when the C-shaped clamps are moved together, the membrane material is restricted to its smallest extant to provide a narrow line, and when moved fully apart, the maximum amount of membrane is exposed to provide the thick writing line.

FIG. 58 illustrates another mechanical version of a variable writing tip end created by having a pair of c-shaped clamp members 394 and 395 respectively between which is contained a mass of sponge membrane material 396. As depicted in FIG. 58, the constriction of the clamp members 394 and 395 into engaging contact will restrict the amount of membrane material 396 available as a writing surface, whereas the reverse action will increase the amount of membrane material available as a writing surface, thereby to accomplish the variable tip writing instrument.

Figure 59:
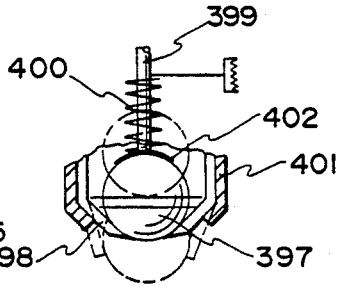
FIG. 59 is a side elevational view, partly in cross section, showing still another alternate embodiment of the writing instrument of the present invention, the variable writing tip being formed by a writing ball carried within an expandable chamber being centrally apertured, the ball being movable between a retracted position thereby to expose the smallest writing diameter, or into an extended position such that the lower portion of the chamber is expanded open and the widest diametric dimension of the ball being exposed for writing purposes to provide the widest writing line.

FIG. 59 once again illustrates another mechanical version to accomplish the same end of a variable writing tip instrument, the variation in the writing tip being formed by having a writing ball 397 contained within a moveable carriage 398. The ball is carried within the confines of the barrel 401 in free rolling fashion and held in position between the socket 402, and the moveable carriage 398. The socket 402 is connected to a shaft 399 which extends upwardly to a control member (not shown) and is spring loaded as between the control member and the socket 402. As the control member is pushed downwardly, against the force of the coil spring 400, the ball is pushed downwardly and the moveable carriage 398 opens to permit more of the ball surface to be exposed out of the writing tip end of the instrument. This action will cause more of the ball to be exposed as a writing tip thereby increasing the thickness of the imprinted character. It will be appreciated that the moveable carriage 398 will only open to a certain extant, which retains the ball 397 within the confines of the barrel 401, and prevents the ball 397 from actually falling out of the instrument. In the fully retracted position of the moveable carriage 398, the carriage 398 seals itself off totally enclosing the ball within the barrel 401 and sealing off the instrument from any writing capacity.

It is contemplated to be within the scope of the present invention that the membranous material utilized as a writing tip may be formed from any number of materials available. Indeed, any material that can function as an ink delivery material for purposes of printing characters, lines, segments, and the like, may be employed within the scope of the present invention, and it is intended to cover herein, any and all materials which can indeed function as an ink delivery material.

It will be appreciated from the above description, that the present invention provides a variable tip writing instrument whereby a single writing tip may be varied by manipulating control means in order to vary the diametric dimension of the writing end of the instrument. This eliminates the need of having multiple points or writing tips contained within the same instrument, which are separately manipulated into writing contact in order to vary the thickness of the line or character to be imprinted by the instrument. In accordance with the above description, it will be further appreciated that various versions and embodiments may be presented which accomplish the same function, namely the function of varying the writing tip by manipulating control means in order to vary the writing tip between a minimum and maximum diametric dimension thereof. It will also be appreciated that the particular control means employed for manipulating and controlling the diametric dimensions of the writing tip end may assume any mechanically efficient structure of the types generally known and presently available, appropriately adapted to the present invention.

It will also be appreciated that in several of the embodiments as illustrated, the control means may be designed in a reverse fashion such that the extension of the control means may present the largest diametric dimension of the tip while retraction presents the smallest diametric dimension. For example, in FIGS. 2*a* and 2*b*, the control rod 27 may be affixed to the outermost ring of the concentric filament 25 such that when extended downwardly, the largest diametric dimension of the tip is presented, and vice versa. It is contemplated that such design reversals are contemplated within the design of the present invention and are intended to be covered by the present specification and appended claims.

In addition, the material forming the writing filament may be made of various materials which are either porous or non-porous or any combination thereof, so long as the same operate to direct ink from the ink supply into writing contact with the paper. Indeed, the writing tip may be formed of any material and simply covered with an appropriate membrane to carry and spread the ink.

Furthermore, it is understood that the final design of the writing instrument of the present invention may include any combination of the designs as depicted herein, and may employ any combination of control means shown herein or otherwise known in the art.

While there has been described what is at present considered to be the preferred embodiments of the invention, it will be understood that various modifications may be made therein all of which are intended to fall within the same spirit and scope of the invention as presented in the appended claims.

I claim:

1. A variable tip writing instrument for printing characters of the type having a storage end and a writing tip end positioned in opposed relation to the storage end, and a barrel adapted to contain a supply of ink formed as a part of the storage end, which is in communication with the writing tip end, the improvement comprising in combination, a writing tip positioned at the writing tip end of said instrument within the confines of the barrel, said writing tip formed from an ink deliver material formed from a porous spongy membranous material, control means associated with said porous spongy membranous material and adapted to control and vary the amount of porous spongy membranous material exposed at the writing tip end of said instrument, said control means including a collar rotatably mounted on the barrel of said writing instrument adjacent the writing tip end thereof, said collar provided with a plurality of shutter blades pivotly secured to said collar and adapted to open and close in response to the rotational movement of said rotatable collar.

said rotatable collar adapted for manipulation between a fully opened positioned exposing the greatest amount of porous spongy membranous material and rotatable to vary the diametric dimension of said shutter blades to a fully closed position, whereby the writing instrument is provided with a single writing tip capable of varying the diametric dimension thereof by said control means between a large and a small diametric dimension thereby to vary the amount of porous spongy membranous material available for imprinting characters.

2. The variable writing tip instrument as set forth in claim 1 above, wherein said rotatable collar is provided with a sponge plate mounted internally thereof and spaced rearwardly from said shutter blades, spring means interposed between the bottom of said barrel and said sponge plate, the coil spring being adapted to apply pressure in downward direction against said sponge plate, and said porous spongy membranous material being interposed between said sponge plate and said shutter bladed whereby upon the rotatable manipulation of said collar thereby to open said shutter blades, said porous spongy membranous material is forced out of the opening created thereby in order to provide a writing tip for said instrument.

3. The variable writing tip instrument as set forth in claim 2 above, wherein said plurality of shutter blades pivotly secured to said collar are adapted to operate in a manner equivalent to a camera shutter thereby to provide a variable writing tip end for said writing instrument.

* * * * *